United States Patent [19]

Christman et al.

[11] 3,997,430

[45] Dec. 14, 1976

[54] HYDRODESULFURIZATION PROCESS INVOLVING BLENDING HIGH BOILING STREAMS

[75] Inventors: Robert D. Christman, Penn Hills Township; Joel D. McKinney, Indiana Township; Thomas C. Readal, McCandless Township; Stephen J. Yanik, Hampton Township, all of Pa.

[73] Assignee: Gulf Research & Development Company, Pittsburgh, Pa.

[22] Filed: Apr. 16, 1975

[21] Appl. No.: 568,555

Related U.S. Application Data

[63] Continuation of Ser. No. 346,116, March 29, 1973, abandoned.

[52] U.S. Cl. ..... 208/211; 208/216

[51] Int. Cl.[2] ..... C10G 23/02

[58] Field of Search ..... 208/211, 216

[56] References Cited

UNITED STATES PATENTS

| | | | |
|---|---|---|---|
| 2,801,208 | 7/1957 | Horne et al. | 208/89 |
| 2,897,143 | 7/1959 | Lester et al. | 208/116 |
| 2,958,654 | 11/1960 | Honeycutt | 208/89 |
| 3,464,915 | 9/1969 | Paterson et al. | 208/211 |
| 3,475,322 | 10/1969 | Eng et al. | 208/216 |
| 3,696,024 | 10/1972 | Stine | 208/211 |
| 3,830,731 | 8/1974 | Reed et al. | 208/211 |
| 3,840,473 | 10/1974 | Beuther et al. | 208/216 |

*Primary Examiner*—Delbert E. Gantz
*Assistant Examiner*—James W. Hellwege

[57] ABSTRACT

A process is described for fixed bed hydrodesulfurizing a non-asphaltic oil feed blend for a zeolitic FCC riser cracking system in which cracking occurs at a space velocity sufficiently high to prevent formation of a catalyst bed. It is shown that sulfur dioxide emissions from the zeolite catalyst regenerator associated with the riser are reduced to a lower extent than total sulfur removal from the feed oil. This indicates uneven sulfur removal in the hydrodesulfurization step whereby a smaller portion of sulfur is removed from the heavy portion of the feed from which the coke is derived than from the lighter portion of the feed. The present invention demonstrates a synergistic effect upon sulfur removal from the heavy portion of the feed by widening the boiling range of the feed and this synergistic effect is converted to practical advantage by reducing the amount of hydrodesulfurization catalyst in proportion to said synergistic effect, thereby keeping hydrocracking to a specified low level. The boiling range of the feed is widened by adding to the higher boiling portion of the feed a portion of a second stream to lower the average boiling point of the hydrodesulfurization feed whereby the sulfur content of the remaining portion of the second stream is sufficiently low that the second stream does not require desulfurization. The further discovery is demonstrated herein that the ratio of gasoline to total conversion during the subsequent riser cracking step of the hydrodesulfurizer effluent is enhanced by reducing the amount of the hydrodesulfurization catalyst as permitted by said synergistic effect.

5 Claims, 7 Drawing Figures

Figure 1:
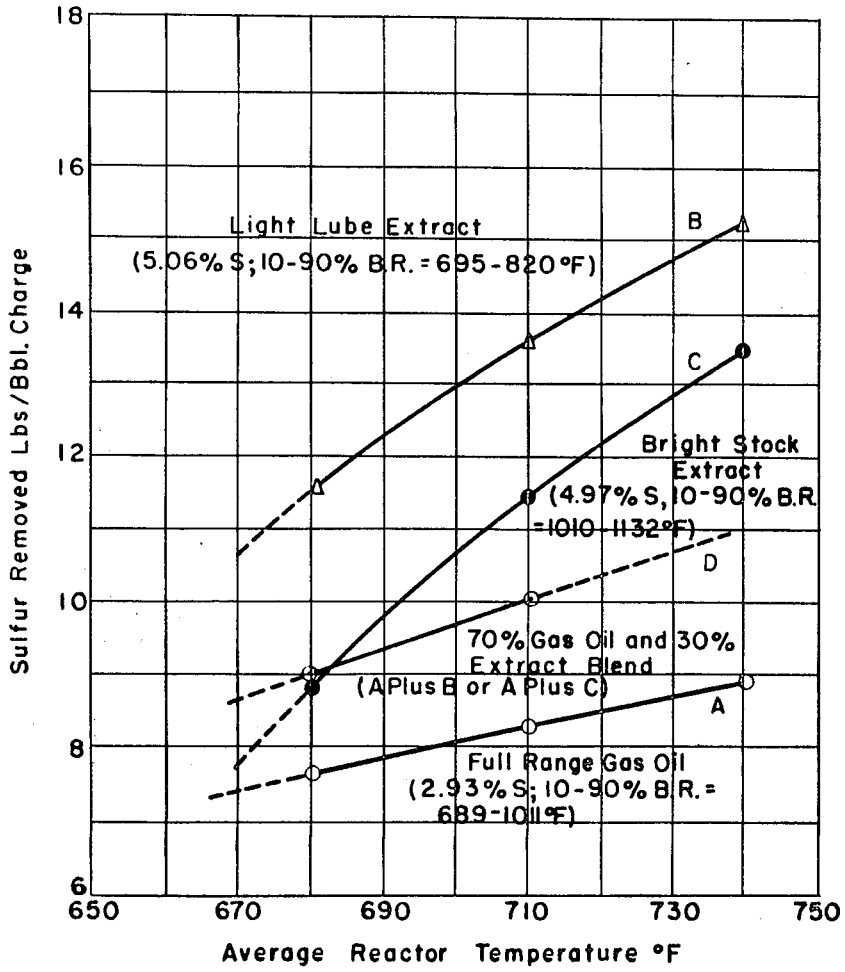

HYDRODESULFURIZATION OF KUWAIT GAS OIL AND VARIOUS KUWAIT LUBE OIL EXTRACT BLENDS: SULFUR REMOVED VERSUS TEMPERATURE

Catalyst: 1/16-inch NiCoMo on Alumina

Operating Conditions: 1000 PSIG, 2.0LHSV, 2000SCF/Bbl. of 70% $H_2$ (Recycle Gas Scrubbed), 85% $H_2$ Makeup

DESULFURIZATION OF KUWAIT $C_5$-680°F DISTILLATE

CHARGE: Blend of 43.5% Deb. Naphtha and 56.5% Furnace Oil
S Content of Naphtha .04%
S Content of Furnace Oil 1.02%

CONDITIONS: 4.0-5.0 LHSV, 700psig press., 1,200 SCF of $H_2$-rich (90%) gas/bbl, gas scrubbed with amine, 400 psi $H_2$pp at outlet.

DESULFURIZATION OF HEAVY OIL PLUS LIGHT OIL

HYDRODESULFURIZATION PROCESS INVOLVING BLENDING HIGH BOILING STREAMS

This is a continuation of application Ser. No. 346,116 filed Mar. 29, 1973, now abandoned.

The present invention is directed to the hydrodesulfurization of non-asphaltic distillate or extract oils. The present invention is particularly directed to the hydrodesulfurization of distillate or extract oils prior to riser cracking of the oils with a zeolite catalyst at a low riser residence time without catalyst bed formation in the riser reaction flow path.

This application is related to five other applications filed on even date herewith under the same inventive entity entitled "Hydrodesulfurization Process Involving Regulation of Amount of Catalyst in Relation to Feed Boiling Range to Limit Hydrocracking". "Hydrodesulfurization Process With a Portion of the Feed Added Downstream in the Reactor", "Combination Hydrodesulfurization and FCC Process", "Hydrodesulfurization and FCC of Blended Stream Containing Coker Gas Oil" and "Hydrodesulfurization Process for Producing Fuel Oil and FCC Feed".

In accordance with this invention, in riser cracking processes charging sulfur-containing feeds, the sulfur content of the feed is reduced by hydrodesulfurization in order to reduce sulfur emissions to the atmosphere. One means of reducing such sulfur emissions to the atmosphere is to hydrodesulfurize substantially an entire gas oil feed stream prior to cracking by passing the gas oil feed stream containing sulfur in the presence of hydrogen downflow over a fixed compacted bed of catalyst particles comprising at least one Group VI and at least one Group VIII metal catalyst on a suitable non-cracking support such as alumina which may or may not contain a stabilizing but non-cracking quantity of silica, i.e. less than about 1 or 0.5 weight percent silica. Examples of suitable hydrodesulfurization catalysts include nickel-cobalt-molybdenum, cobalt-molybdenum, nickel-tungsten and nickel-molybdenum. Suitable hydrodesulfurization conditions include a temperature range of 650° to 800° F., generally, and 670° to 800° F., preferably, a pressure range of 500 to 1800 psig, generally, 800 to 1500 psig, preferably, and 800 to 1200 psig, most preferably, a space velocity range of 0.5 to 5 LHSV, based upon the heavy portion of the total feed only (e.g. 650° to 1050° F. feed), generally, and 0.7 to 2 LHSV, preferably, and a circulation rate of 1000 to 8000 SCF/B, generally, and 2000 to 3000 SCF/B, preferably, based on the heavy feed portion of the total feed (i.e. the 650° to 1050° F. feed portion) of hydrogen or a gas containing generally about 75 to 80 percent hydrogen. Hydrogen consumption varies depending on process conditions, feed sulfur content, etc. and can range from 100 to 500 SCF/B, based on said heavy portion of the feedstock, generally. For example, in a feed containing about 3.0 weight percent sulfur, about 400 SCF/B of hydrogen consumption occurs at about 1000 psig and about 500 SCF/B of hydrogen is consumed at about 1800 psig. The above ranges are based upon the heavy oil portion only of a total feed, which can also contain a light portion (such as 400° F. to 600° or 650° F. furnace oil), because the primary objective of the hydrodesulfurization is the removal of the sulfur from the heavy oil portion and it is the heavy oil portion in which most of the sulfur is concentrated.

When a desulfurized feed is charged to a zeolite FCC riser operated without hydrogen addition thereto and having a catalyst regenerator associated therewith for continuous catalyst regeneration, removal of sulfur from the feed stream results in a reduction in sulfur emitted in the product gases from the riser and also results in a reduction in sulfur emitted from the flue gases of the regenerator. However, we have found that the reduction of sulfur emitted from the riser is greater than the reduction of sulfur emitted from the regenerator. This is a disadvantageous feature because the sulfur emitted from the FCC riser is emitted in the form of hydrogen sulfide which is formed by the scission of a molecule at an internal sulfur atom by means of splitting off hydrogen sulfide from the molecule, thereby producing olefinic fragments of the parent molecule. The formation of hydrogen sulfide is not particularly serious because the hydrogen sulfide can be scrubbed from gases from the FCC riser with an amine solution, such as monoethanolamine, which is known to be capable of removing hydrogen sulfide. Therefore, the hydrogen sulfide formed in the riser does not reach the atmosphere.

On the other hand, sulfur off-gas formation in the regenerator is due to the presence of sulfur-containing coke which forms on the zeolite cracking catalyst when the liquid feed first contacts hot regenerated catalyst at the bottom of the riser. The coke is formed from the highest boiling portions of the feed which fail to vaporize and most of the sulfur present in the coke which reaches the regenerator is the sulfur present in the highest boiling hydrocarbon feed molecules. Upon combustion in the regenerator in the presence of oxygen, the sulfur in the coke is converted to sulfur dioxide or sulfur trioxide, while the carbon is converted to carbon monoxide or carbon dioxide. The sulfur oxides formed in the regenerator form a more serious atmospheric pollution problem than the hydrogen sulfide formed in the FCC riser because the sulfur oxides cannot be easily removed by scrubbing of the regenerator flue gas prior to reaching the atmosphere. Therefore, sulfur oxides formed by combustion in the regenerator are emitted to the atmosphere in the regenerator flue gas as noxious atmospheric pollutant. For a diagrammatic scheme of a riser-regenerator system of the type contemplated in this invention, see FIG. 3 of U.S. Pat. No. 3,617,512, which is hereby incorporated herein, wherein sulfur dioxide is removed from the regenerator through line 74 while hydrogen sulfide is removed from the riser through line 56, from which it can be amine-scrubbed.

We have found that, disadvantageously, for any degree of sulfur removal in the total hydrocarbon feed stream to the FCC riser the percent reduction in the noxious sulfur dioxide formed in the regenerator is less than the overall percent of sulfur removed from the total feed stream. The reason is that the sulfur dioxide formed in the regenerator is derived from sulfur present in the higher boiling molecules of the feed which are the molecules in the feed which are the most difficult to hydrodesulfurize. These high boiling molecules do not vaporize when the feed stream contacts hot regenerated catalyst at the equilibrium flash vaporization temperature at the bottom of the riser and therefore are converted to the coke which is formed on the catalyst in the bottom of the riser. In one test it was found that the desulfurization of a West Texas gas oil blend reduced the sulfur content from a feed sulfur content of 1.75 weight percent to 0.21 weight percent (88.0 percent reduction in sulfur). When this feed containing 1.75 weight percent sulfur was cracked without hydrodesulfurization the weight fraction of feed sulfur which ended up in the regenerator flue gas was 0.051 whereas when the feed was hydrodesulfurized as described the weight fraction of sulfur in the hydrodesulfurization feed which appeared in the flue gas increased to 0.087. Multiplying 1.75 pounds of sulfur per 100 pounds of non-hydrodesulfurized feed times the 0.051 weight fraction equals 0.089 pounds of sulfur emitted; whereas multiplying 0.21 pounds of sulfur per 100 pounds of hydrodesulfurized feed times the 0.087 weight fraction equals 0.018 pounds of sulfur. This represents a reduction of only 79.8 percent in the weight of sulfur emitted from the regenerator flue gas as compared to a total reduction of 88.0 percent reduction in sulfur in the feed. Therefore an 88 percent reduction of sulfur content in the feed stream results in only a 79.8 percent reduction in sulfur emitted from the FCC regenerator stack gases.

The following table shows how hydrodesulfurization of the aforementioned gas oil feed stream changed the distribution of sulfur in the various streams associated with a FCC riser. The non-desulfurized feed contained 1.75 weight percent sulfur. The desulfurized feed contained 0.21 weight percent sulfur.

| SULFUR DISTRIBUTION IN PERCENT - NON-DESULFURIZED FEED | | | |
|---|---|---|---|
| $H_2S$ | In Gasoline | In Cycle Oil | In Regenerator Flue Gas |
| 45 | 4 | 46 | 5 |
| **SULFUR DISTRIBUTION IN PERCENT - DESULFURIZED FEED** | | | |
| $H_2S$ | In Gasoline | In Cycle Oil | In Regenerator Flue Gas |
| 19 | 3 | 69 | 9 |

The above data show that, although the total amount of sulfur in the flue gas is reduced, the proportion of total remaining sulfur that ends up in the regenerator flue gas almost doubles as a result of desulfurization of the feed. Hydrodesulfurization of the feed oil clearly results in uneven removal of sulfur from the feed oil.

The above data indicate that any hydrodesulfurization process for the removal of sulfur from the feed stream to an FCC zeolite cracking riser (fluid catalytic cracker) should be encouraged to be more favorable to removal of sulfur from the highest boiling molecules as compared to the lowest boiling molecules in the feed. This is because the data show a disproportionate increase in sulfur in the regenerator flue gas and in the cycle oil, both of which streams are derived from the sulfur in the highest boiling portions of the feed. This presents a difficult problem because the desulfurization reaction rate constant for the lower boiling molecules in the cracking feed stream is exponentially higher than the desulfurization reaction rate constant of the higher boiling molecules. For example, the desulfurization reaction rate constant of a feed having a volume average boiling point of 493° F. is 185 whereas the desulfurization reaction rate constant of a feed having a volume average boiling point of 1043° F. is only 2.75. The exponential relationship between desulfurization reaction rate constant and volume average boiling point of a hydrocarbon feed is shown in Table 1.

TABLE 1

| Volume Average B.P. of Feed - ° F. | Desulfurization Reaction Rate Constant |
|---|---|
| 1043 | 2.75 |
| 735 | 5.26 |
| 665 | 8.29 |
| 602 | 17.9 |
| 545 | 51.4 |
| 493 | 185 |
| 350 – 400 | Above 10,000 |

The above data illustrate the great difficulty associated with removing sulfur from the high boiling portions of a feed stream as compared with the low boiling portions of the same feed when the feed source has a significantly wide boiling range.

In accordance with the present invention we have discovered a means of improving desulfurization of the higher boiling components in a hydrocarbon feed stream. Our discovery is based upon data showing the existence of a synergistic effect in desulfurization reaction rate between the lowest and the highest boiling sulfur-containing molecules in the hydrodesulfurization process wherein desulfurization of the highest boiling sulfur-containing molecules is enhanced at the expense of desulfurization of the lower boiling sulfur-containing molecules but because the higher boiling portions of the feed are richer in sulfur there is a net positive effect in terms of total sulfur removal due to the synergism. We have found that when the hydrodesulfurization reaction is controlled in such a manner that there is a high degree of selectivity toward desulfurization as contrasted to hydrocracking the synergistic effect may be used to maximum advantage. The low boiling molecules assist the high boiling molecules in the desulfurization process, perhaps by alternating use of the same reaction sites wherein the rapidly reacting lighter molecules utilize a given site between utilization of the site by consecutive slower reacting heavy molecules. Because the lighter molecules react so rapidly, the active sites are available to the heavy molecules a greater portion of the time than when the heavy molecules are processed alone at the same space velocity. We have observed that as the boiling range of a hydrocarbon feed stream is increased the amount of catalyst required to accomplish a given degree of hydrodesulfurization per barrel of feed diminishes as compared to the hydrodesulfurization of the high and low boiling portions of the same stream in separate reactors at the same conditions, indicating the occurrence of a synergistic sulfur removal effect between molecules of different boiling points. For example, Table 2 shows that for a particular crude source as the difference in temperature between the end point and the initial boiling point of a feed stream having a volume average boiling point of 850° F. increases there is a proportional reduction in catalyst requirement, compared to that required for treating the light and heavy halves of the feed separately, to accomplish a given amount of sulfur removal. Table 3 shows that for the same crude source, as the difference in temperature between the end point and the initial boiling point of a feed stream having a volume average boiling point of 750° F. increases there is a corresponding reduction in catalyst requirement as compared to that required for treating the light and heavy halves separately, without changing other conditions. The reduction in catalyst requirement to accomplish a given amount of sulfur removal without changing other reaction conditions is different when the feed has a volume average boiling point of 750° F. as compared to a feed having a volume average boiling point of 850° F. In both cases, the reduction in catalyst requirement increases as the breadth of boiling range increases. The basis for comparison in determining the reduction in catalyst requirement in Tables 2 and 3 is the amount of catalyst that would be required if the same amount of feed oil containing a given amount of sulfur is treated, except that the temperature differential between the E. P. and I. B. P. is changed as indicated. For example, the 0 data point in Tables 2 and 3 represent a given quantity of oil, all of which boils at 850° and 750° F., respectively. The second data point represents the same quantity of oil having a boiling range extending over 100° F. The third data point represents the same quantity of oil having a boiling range extending over 200° F. The data show that significant reductions in catalyst requirements become possible when the boiling range of the feed oil is at least 400° or 500° F. wide when the volume average boiling point of the feed is at least 750° F. Even greater savings in catalyst becomes possible if the range between the feed IBP and EP is at least 600° F.

TABLE 2

| Reduction in Catalyst Requirement for Feed Having a Volume Average B.P. of 850° F. - Percent | E.P. - I.B.P. of Feed - ° F. |
|---|---|
| 0 | 0 |
| 0.2 | 100 |
| 3 | 200 |
| 7 | 300 |
| 11 | 400 |
| 16 | 500 |

TABLE 3

| Reduction in Catalyst Requirement for Feed Having a Volume Average B.P. of 750° F. - Percent | E.P. - I.B.P. of Feed - ° F. |
|---|---|
| 0 | 0 |
| 0.1 | 100 |
| 1 | 200 |
| 3 | 300 |
| 8 | 400 |
| 18.5 | 500 |
| 31.5 | 600 |

It is important to the present invention that the catalyst economy permitted by broadening the feed boiling range be correlated with the synergistic effect to remove a substantial amount of the most refractory sulfur in the feed with diminished hydrocracking. Therefore, in accordance with the present invention the synergistic effect should not be permitted to reduce the catalyst quantity to the extent that the 90 percent point of the feed is not reduced at least 10° F. or 15° F., indicating a substantial removal of the most refractory sulfur in the feed in spite of the reduced quantity of catalyst. At the same time, the catalyst reduction should be sufficient so that the 10 percent distillation point of the feed is not lowered more than 20° F. more than the 90 percent distillation point, and in any event the 10 percent distillation point is not lowered more than 50° F. In this manner, the amount of catalyst is limited to advantageously permit both enhanced desulfurization (cleavage of carbon-sulfur bonds) while significantly inhibiting hydrocracking (cleavage of carbon-carbon bonds). Therefore, in accordance with this invention, under the same reaction conditions proportionately more catalyst is required to remove the same amount of sulfur from the higher-boiling half of the total feed when it is treated by itself than if the higher-boiling half of the total feed is hydrodesulfurized in blend with a lower boiling half of a total feed stream. With certain feeds, the reduced catalyst requirement when treating the blend permits the blend-treatment process to be terminated before decreasing the boiling characteristics of the feed beyond that described above.

Data were taken (Table 4 and FIG. 1) to illustrate that the synergistic effect of the present invention is highly surprising and is a synergistic effect based upon the sulfur removal reaction. For example, data were taken employing as a hydrodesulfurization feed a full range gas oil containing 2.93 percent sulfur. The 10 and 90 percent distillation points of the full range gas oil were 680° and 1011° F. respectively. Thereupon, blends of the gas oil and lubricating oil extracts were prepared, each lubricating oil extract stock having about the same sulfur content but a different boiling range and a different viscosity. In one case the lubricating oil extract was a light lubricating oil extract containing 5.06 weight percent sulfur having 10 and 90 percent distillation points of 695° and 820° F., respectively. The light lubricating oil had a boiling range within the boiling range of the full range gas oil and was of about the same viscosity. In the second case the lubricating oil extract was a bright stock extract whose boiling range extended considerably outside the boiling range of the full gas oil on the high side, having a 10 percent distillation point of 1010 and an estimated 90 percent distillation point of 1132° F., respectively, and was considerably more viscous than the gas oil. The bright stock extract had a sulfur content of 4.97 weight percent. In each case where a gas oil-lubricating oil extract blend was desulfurized, the blend comprised 70 percent of a portion of the same gas oil together with 30 percent of the particular lubricating oil extract, i.e. either the light lubricating oil extract or the bright stock extract.

It would be expected that the blend containing the bright stock extract would have been more difficult to desulfurize because it had a higher average boiling point and was more viscous than the blend containing the light lubricating oil extract which had a boiling point within the range of the gas oil with which it was blended and about the same viscosity. This expectation is especially true since data show that the bright stock extract, by itself, was considerably more difficult to hydrodesulfurize than the light lubricating oil extract, by itself. However, it was unexpectedly found that there was a considerable synergistic effect in regard to sulfur removal in the case of the blend of the bright stock extract and the gas oil, even though the bright stock boiled considerably above the upper boiling point of the gas oil and had a considerably higher viscosity, which would be expected to slow the reaction rate. It was further found that there was no synergistic effect in regard to sulfur removal in the case of the blend of the gas oil and the light lubricating oil extract whose boiling range was within the boiling range of the gas oil. These results are shown in Table 4 and are illustrated in FIG. 1.

TABLE 4

HYDRODESULFURIZATION OF KUWAIT GAS OIL AND BLENDS OF KUWAIT GAS OIL AND KUWAIT LUBE OIL EXTRACTS

| | Charge and Product Inspections | | | | | | |
|---|---|---|---|---|---|---|---|
| | Full Range Gas Oil | 70% G.O. - 30% Light Lube Extract | | | 70% G.O. - 30% Bright Stock Extract | | |
| Hydrodesulfurization Temperature: ° F. | Charge (Not hydro-desulfurized) | Charge (Not hydro-desulfurized | 680 | 710 | Charge (Not hydro-desulfurized) | 680 | 710 |
| Inspections | | | | | | | |
| Gravity: ° API | 22.4 | 18.1 | 23.6 | 24.4 | 19.2 | 23.9 | 24.5 |
| Sulfur: % by weight | 2.93 | 3.63 | 0.91 | 0.60 | 3.66 | 0.94 | 0.61 |
| Viscosity: SUS | | | | | | | |
| 100° F. | 301.4 | 550 | — | — | 1320 | — | — |
| 130° F. | 119.3 | 220 | 82.3 | 74.9 | 310 | 171.2 | 146 |
| 210° F. | 48.7 | — | 42.2 | 41.0 | — | 55.1 | 52.1 |
| Distillation, Vacuum: D1160 | | | | | | | |
| 10% at ° F. | 689 | 700 | 671 | 643 | 710 | 710 | 687 |
| 30% | 754 | 738 | 728 | 719 | 792 | 803 | 777 |
| 50% | 818 | 780 | 773 | 765 | 894 | 903 | 864 |
| 70% | 897 | 845 | 837 | 827 | 999 | 1004 | 964 |
| 90% | 1011 | 948 | 944 | 936 | 1079 | 1110 | 1061 |
| End Point: ° F. | — | 1051 | 1015 | 1015 | — | — | — |

The surprising results in regard to Table 4 are shown in the following summation entitled Table 4A which contains data directly extracted from Table 4.

TABLE 4A

| | 70% - G.O. - 30% Light Lube Extract | | | 70% G.O. - 30% Bright Stock Extract | | |
|---|---|---|---|---|---|---|
| Hydrodesulfurization Temperature: ° F. | — | 680 | 710 | — | 680 | 710 |
| Sulfur in Feed - Weight Percent | 3.63 | | | 3.66 | | |
| Sulfur in Product - Weight Percent | | 0.91 | 0.60 | | 0.94 | 0.61 |
| Increase in difference between the 10 and 90 percent distillation points due to hydro-desulfurization | | 25 | 45 | | 31 | 5 |
| Temperature of 90 percent point: ° F. | 948 | 944 | 936 | 1079 | 1110 | 1061 |

Table 4A shows that the mixture containing the gas oil and light lube extract had about the same sulfur content as the mixture containing the gas oil and bright stock extract. Table 4A further shows that at desulfurization temperatures of 680° and 710° F., respectively, about the same degree of sulfur removal occurred with each charge stock. These data tend to obscure and hide the discovery of the present invention since they tend to show that any feedstock having a fixed feed sulfur content is desulfurized to the same extent at the same desulfurization conditions. However, the results shown in Table 4A become surprising when it is realized that the bright stock extract mixture is much more viscous than the mixture containing the light lube oil extract and therefore would have been expected to result in a lower degree of sulfur removal due to diffusion difficulties arising from its higher viscosity. This expectation is especially true in view of FIG. 1 which shows that the unblended and less viscous light lubricating oil extract is more easily desulfurized than the unblended and more viscous bright stock extract under similar conditions. Tables 4 and 4A show that a synergistic effect becomes controlling due to a widening of feed boiling range by blending a material having an overlapping, continuous or broader boiling range. As explained below, the synergistic effect upon reaction rate upon blending is also illustrated in FIG. 1, by comparing curves B and C and observing that in blend they both produce curve D.

Table 4A also shows that the gas oil-light lubricating oil extract blend was not capable of hydrodesulfurization without an increase in the temperature difference between the 10 and 90 percent distillation points of more than 20° F., indicating the onset of significant hydrocracking, whereas the 710° F. test with the gas oil-bright stock extract blend resulted in only a 5° F. increase in this temperature differential, indicating very little hydrocracking accompanying the desulfurization reaction, while the 90 percent point dropped from 1079° to 1061° F. (18° F.), indicating a significant removal of sulfur from the highest boiling, most viscous portion of the feed. In the test in which there was only a 5° F. temperature differential increase, this low temperature differential increase was accomplished because there was no increase in quantity of catalyst upon widening the boiling range of the feed. If the quantity of catalyst were increased, as by lengthening the catalyst bed, extensive hydrocracking would have been encountered when low sulfur levels were reached because the presence of sulfur serves to inhibit onset of extensive hydrocracking. Therefore, the sulfur-removal synergistic effect of the present invention requires that the quantity of catalyst be controlled or limited as the boiling range of the feed oil is widened if extensive hydrocracking is being experienced with that boiling range. Thereby, the savings in catalyst required increases as the boiling range of the feed widens.

FIG. 1 illustrates diagrammatically the synergistic effect based upon the data in Table 4 and Table 4A. Referring to FIG. 1, line A shows the desulfurization characteristics versus reaction temperatures of the full range gas oil by itself. Line B shows the desulfurization characteristics of the light lubricating oil extract by itself versus reaction temperatures. Line C shows the desulfurization characteristics of the much heavier bright stock extract by itself versus reaction temperatures. FIG. 1 shows that even though the bright stock extract had about the same amount of sulfur in the feed as the light lubricating oil extract, because of its higher viscosity, and lower reaction rate due to its higher boiling range, as expected, less sulfur was removed when it was treated by itself. This shows that when the bright stock extract is treated by itself and when the light lubricating oil extract is treated by itself viscosity and reaction rate due to boiling range (see Table 1) is a controlling feature in the hydrodesulfurization reaction.

Line D in FIG. 1 represents the sulfur removal characteristics versus reaction temperatures of (1) the blend of the gas oil of curve A and the light lubricating oil extract curve B, and also (2) the separate blend of the gas oil of curve A and the bright stock extract of curve C. Line D unexpectedly shows the same desulfurization results are achieved when a 70 percent — 30 percent blend of gas oil is made up with either the light lubricating oil extract or the much heavier and more viscous bright stock extract. Line D therefore shows there is a synergistic effect in reaction rate between the bright stock extract, which boils above the boiling range of the gas oil, which overcomes the diffusion limitation due to viscosity whereas there is no synergistic effect in the case of the blend of the gas oil and the light lubricating oil extract wherein the light lubricating oil boils within the boiling range of the gas oil. In general, the wider the boiling range to which a feedstock can be extended, the greater will be the synergistic effect between the lightest- and heaviest-boiling components in regard to hydrodesulfurization synergism.

There are two surprising aspects in the discovery that the blend of high boiling bright stock extract and gas oil provide the same hydrodesulfurization characteristics as the blend of the lower boiling light lubricating oil extract and gas oil. Since the bright stock extract has a boiling range higher than the gas oil, it is not only more viscous than the gas oil and therefore should provide a high diffusion resistance in the hydrodesulfurization reaction but also, as shown in Table 1, it has a lower reaction rate constant because of its high average boiling point, as compared to the lower boiling light lubricating oil extract. However, both (1) the high viscosity diffusion effect which provides resistance against the hydrodesulfurization reaction in the absence of blending and (2) the lower reaction rate constant of the bright stock extract due to its higher average boiling point were overcome to the extent that the bright stock extract blend with the gas oil exhibited the same hydrodesulfurization characteristics as the blend of the light lubricating oil extract with the gas oil, the latter blend not having overlapping boiling ranges. Therefore, there is a considerable synergistic effect in reaction rate by combining stocks having overlapping boiling ranges causing the boiling range of the blend to be wider than the boiling range of either component alone. The same effect could be obtained by preparing directly via distillation a hydrodesulfurization feedstock having a very wide boiling range. The advantageous result of the present invention can be achieved by combining feedstocks in a single reactor which ordinarily are hydrodesulfurized in several reactors such as furnace oil, light gas oil, heavy gas oil, light and medium lubricating oil, light and medium lubricating oil extracts, coker gas oil, FCC cycle oil, and so forth, in a manner that the improved synergism in regard to the sulfur removal reaction rate is greater than the detriment due to the inhibited diffusion effect and low reaction rate contributed by the higher-boiling component. Example 7 shows a special effect occurs when a virgin gas oil is blended with coker gas oil. One or all of the mixed streams can be separated from the hydrodesulfurized blend effluent, if desired. For example, heavy gas oil and furnace oil can be blended prior to hydrodesulfurization and then separated following desulfurization, with the furnace oil being employed as a fuel and the heavy gas oil being employed as an FCC feedstock.

Tables 4B and 4C present a tabulation of the feed and product data from which curves B and C of FIG. 1 were obtained. In Table 4C, certain boiling points of the feed were estimated because of the difficulty of distillation of very high boiling material.

TABLE 4B

HYDRODESULFURIZATION OF KUWAIT LIGHT LUBE EXTRACT at 1000 psig, 2 vol/hr/vol and 2000 SCF/B

| Hydrodesulfurization Temperature: ° F. | Charge (Not hydro-desulfurized) | 680 | 710 | 740 |
|---|---|---|---|---|
| Inspections | | | | |
| Gravity: ° API | 9.4 | 16.9 | 17.7 | 18.6 |
| Sulfur: % by weight | 5.06 | 1.77 | 1.18 | 0.73 |
| Desulfurization: % | — | 65.0 | 76.8 | 85.7 |
| Distillation, Vacuum: D1160 | | | | |
| 10% at ° F. | 695 | 633 | 612 | 574 |
| 30% | 718 | 680 | 673 | 654 |
| 50% | 742 | 712 | 707 | 694 |
| 70% | 771 | 744 | 740 | 738 |
| 90% | 820 | 793 | 807 | 784 |
| End Point | 884 | 856 | 855 | — |

TABLE 4C

HYDRODESULFURIZATION OF KUWAIT BRIGHT STOCK EXTRACTS at 1000° F., 2 vol/hr/vol and 2000 SCF/B

| Hydrodesulfurization Temperature - ° F. | Charge (Not hydro-desulfurized) | 680 | 710 | 740 |
|---|---|---|---|---|
| Inspections | | | | |
| Gravity: ° API | 12.3 | 17.4 | 18.7 | 19.5 |
| Sulfur: % by weight | 4.97 | 2.41 | 1.63 | 0.98 |
| Desulfurization: % | — | 51.5 | 67.2 | 80.4 |
| Distillation, Vacuum: D1160 | | | | |
| 10% at ° F. | 1010 | 956 | 883 | 832 |
| 30% | 1034 | 1005 | 988 | 980 |
| 50% | 1057 | 1046 | 1040 | 1022 |
| 70% | 1086 | — | 1093 | — |
| 90% | 1132 | — | — | — |
| End Point | — | — | — | — |

Further tests were performed to illustrate the synergistic effect in hydrodesulfurization reaction rate utilizing a nickel-cobalt-molybdenum on alumina catalyst (all hydrodesulfurization tests reported herein utilized this type of catalyst composition unless otherwise noted) when the added stream has a boiling range which overlaps, is contiguous with or extends beyond that of the primary stream, but where the extension is on the low-temperature side of the range. Tests were made in which a blend containing 35 weight percent of furnace oil having a boiling range of 475° to 638° F. was added to full range gas oil having a boiling range of 615° to 1005° F. containing light lubricating oil extract having a boiling range of 706° to 840° F. The results of these tests are shown in Table 5 and in Table 6.

TABLE 5

HYDRODESULFURIZATION OF BLENDED CHARGE STOCKS

Conditions: 680° F., 940 psig, 0.8 LHSV, 2000 SCF/B (80% $H_2$)

| | | | | |
|---|---|---|---|---|
| Charge Sulfur Content 1.43 weight % | → | Kuwait Furnace Oil (475–638° F. B.R.) | → | Product Sulfur Content - 11 ppm<br>Product Yield - 97.91 wt % of fresh feed<br>Unit Hydrogen Consumption - 387 SCF/B<br>Aromatics decreased from 36 to 21 vol % |
| Charge Sulfur Content 2.74 weight % | → | Kuwait Full Range Gas Oil (615–1005° F. B.R.) | → | Product Sulfur Content - 0.18 wt %<br>Product Yield - 96.65 wt % of fresh feed<br>Unit Hydrogen Consumption - 499 SCF/B<br>Aromatics decreased from 51 to 41 vol % |
| Charge Sulfur Content 6.03 weight % | → | Kuwait Lube Oil Extract* (706–840° F. B.R.) | → | Product Sulfur Content - 0.88 wt %<br>Product Yield - 94.52 wt % of fresh feed<br>Unit Hydrogen Consumption -1024 SCF/B<br>Aromatics decreased from 88 to 81 vol % |
| | Hydrodesulfurizing a Blend of | 35 wt % Kuwait Furnace Oil<br>53 wt % ZKuwait Full Range Gas Oil<br>12 wt % Kuwait Lube Oil Extract | | |
| Charge Sulfur Content 2.68 weight % | → | Calc. Results for the Blended Material** | → | Product Sulfur Content - 0.20 wt %<br>Product Yield - 96.84 wt % of Fresh Feed<br>Hydrogen Consumption - 514 SCF/B<br>Aromatics - 38.2 vol % |
| Charge Sulfur Content 2.68 wt % | → | Observed Results for the Blended Material | → | Product Sulfur Content - 0.14 wt %<br>Product Yield - 96.26 wt % of fresh feed<br>Unit Hydrogen Consumption - 463 SCF/B<br>Aromatics - 40.0 vol % |

*This run was made at 3000 SCF/B reactor gas rate to compensate for high hydrogen consumption.
**Results calculated by algebraic combination of component results shown above.

TABLE 6

HYDRODESULFURIZATION OF BLENDED CHARGE STOCKS
Conditions: 680° F., 940 psig, 1.6 LHSV, 2000 SCF/B (80% $H_2$)

| | | | | |
|---|---|---|---|---|
| Charge Sulfur Content 1.43 weight % | → | Kuwait Furnace Oil (475–638° F. B.R.) | → | Product Sulfur Content - 55 ppm<br>Product Yield - 98.03 wt % of fresh feed<br>Unit Hydrogen Consumption - 276 SCF/B |
| Charge Sulfur Content 2.74 weight % | → | Kuwait Full Range Gas Oil (615–1005° F. B.R.) | → | Product Sulfur Content - 0.37 wt %<br>Product Yield - 97.00 wt % of fresh feed<br>Unit Hydrogen Consumption - 356 SCF/B |
| Charge Sulfur Content 6.03 weight % | → | Kuwait Lube Oil Extract* (706–840° F. B.R.) | → | Product Sulfur Content - 1.71 wt %<br>Product Yield - 96.40 wt % of fresh feed<br>Unit Hydrogen Consumption - 884 SCF/B |
| | Hydrodesulfurizing a Blend of | 35 wt % Kuwait Furnace Oil<br>53 wt % Kuwait Full Range Gas Oil<br>12 wt % Kuwait Lube Oil Extract | | |
| Charge Sulfur Content 2.68 weight % | → | Calc.Results for the Blended Material** | → | Product Sulfur Content - 0.40 wt %<br>Product Yield - 97.29 wt % of fresh feed<br>Hydrogen Consumption - 383 SCF/B<br>Aromatics - 40.5 vol % |
| Charge Sulfur Content 2.68 weight % | → | Observed Results for the Blended Material | → | Product Sulfur Content - 0.28 wt %<br>Product Yield - 97.39 wt % of fresh feed<br>Unit Hydrogen Consumption - 370 SCF/B<br>Aromatics - 40.9 vol % |

*This run made at 3000 SCF/B reactor gas rate to compensate for high hydrogen consumption.
**Results calculated by algebraic combination of component results shown above.

Table 5 shows that when the full range gas oil, the light lubricating oil extract and the furnace oil is each hydrodesulfurized by itself, the calculated results would indicate a product having 0.20 weight percent sulfur but that when the streams were blended and desulfurized together the product had a sulfur content of 0.14 weight percent sulfur, indicating the existence of a synergistic effect upon the reaction rates by blending a stream (the furnace oil) which extends beyond the boiling range of the primary stream on the lower boiling side. Table 6 shows a proportionally similar synergistic effect occurs (sulfur removal is increased from an expected value of 85 percent to a value of 90 percent) with the same system when the space velocity is doubled from 0.8 to 1.6 LHSV. Tables 5 and 6 also show that unit hydrogen consumption (chemical hydrogen consumption by free hydrogen balance around the unit) is lower when the blend is treated than would have been expected, even though more sulfur is removed than expected. This demonstrates the synergistic effect, whereby sulfur removal is high while the extent of undesirable hydrogen-consuming reactions (hydrogenation and hydrocracking) are limited. Of course, limiting hydrogen consumption is economically advantageous, and controlling both hydrogenation and hydrocracking leads to the production of a superior gasoline in the subsequent riser cracking step.

Table 7 shows the characteristics of the furnace oil feedstock of Tables 5 and 6 and the furnace oil effluent from the hydrodesulfurization reactor at a space velocity of both 0.8 and 1.6 when the furnace oil is hydrodesulfurized by itself.

TABLE 7

| HYDRODESULFURIZING OF KUWAIT FURNACE OIL | | | |
|---|---|---|---|
| Average Reactor Temperature: ° F. | | 680 | 680 |
| Reactor Pressure: psig | | 939 | 939 |
| LHSV: vol/hr/vol | | 1.60 | 0.80 |
| Gas Rate: SCF/B | | 1942 | 1963 |
| $H_2$ Content of Reactor Gas: vol % | | 81.0 | 80.7 |
| Hydrogen Consumption: SCF/B (Unit) | | 276 | 387 |
| Total Liquid Product Yield: wt % of fresh feed | | 98.03 | 97.91 |
| Liquid Product Inspections | Feed | | |
| Gravity: ° API | 35.2 | 38.3 | 39.8 |
| Sulfur: wt % | 1.43 | 55 ppm | 11 ppm |
| Distillation, ASTM D86: ° F. | | | |
| EP | 638 | 635 | 642 |
| 5% | 475 | 453 | 452 |
| 10% | 488 | 474 | 470 |
| 20% | 506 | 497 | 490 |
| 30% | 526 | 514 | 508 |
| 40% | 542 | 529 | 524 |
| 50% | 556 | 543 | 540 |
| 60% | 570 | 557 | 552 |
| 70% | 584 | 572 | 568 |
| 80% | 598 | 590 | 588 |
| 90% | 616 | 611 | 608 |
| 95% | 627 | 622 | 622 |

Table 8 shows the characteristics of the light lubricating oil feedstock extract of Tables 5 and 6 and the effluent from the hydrodesulfurizing reactor when the light lubricating oil extract feedstock is hydrodesulfurized by itself at space velocities of 0.8 and 1.6.

TABLE 8

| HYDRODESULFURIZING OF KUWAIT LUBE OIL EXTRACT | | | |
|---|---|---|---|
| Average Reactor Temperature: ° F. | | 681 | 680 |
| Reactor Pressure: psig | | 941 | 941 |
| LHSV: vol/hr/vol | | 0.80 | 1.59 |
| Gas Rate: SCF/B | | 2969 | 2988 |
| $H_2$ Content of Reactor Gas: vol % | | 80.3 | 79.4 |
| Hydrogen Consumption: SCF/B (Unit) | | 1042 | 884 |
| Total Liquid Product Yield: wt % of fresh feed | | 94.52 | 96.40 |
| Liquid Product Inspections | Feed | | |
| Gravity: ° API | 9.3 | 18.6 | 18.1 |
| Sulfur: wt % | 6.03 | 0.88 | 1.71 |
| Distillation, ASTM D86: ° F. Vacuum: 10 MM | | | |
| EP | 840 | 831 | 829 |
| 5% | 706 | 584 | 622 |
| 10% | 709 | 616 | 646 |

TABLE 8-continued

| HYDRODESULFURIZING OF KUWAIT LUBE OIL EXTRACT | | | |
|---|---|---|---|
| 20% | 716 | 648 | 669 |
| 30% | 728 | 667 | 684 |
| 40% | 735 | 684 | 700 |
| 50% | 743 | 698 | 712 |
| 60% | 754 | 712 | 726 |
| 70% | 765 | 726 | 740 |
| 80% | 779 | 742 | 754 |
| 90% | 799 | 765 | 781 |
| 95% | 813 | 778 | 795 |

Table 9 shows the characteristics of the gas oil feedstock of Tables 5 and 6 and the gas oil hydrodesulfurized effluent when the gas oil feedstock is hydrotreated by itself at space velocities of 0.8 and 1.6.

TABLE 9

| HYDRODESULFURIZING OF KUWAIT GAS OIL | | | |
|---|---|---|---|
| Average Reactor Temperature: ° F. | | 680 | 681 |
| Reactor Pressure: psig | | 939 | 939 |
| LHSV: vol/hr/vol | | 0.82 | 1.60 |
| Gas Rate: SCF/Bbl | | 1940 | 1947 |
| $H_2$ Content of Reactor Gas: vol % | | 79.9 | 79.3 |
| Hydrogen Consumption: SCF/Bbl (Unit) | | 499 | 356 |
| Total Liquid Product Yield: wt % of fresh feed | | 96.65 | 97.00 |
| Liquid Product Inspections | Feed | | |
| Gravity: ° API | 25.0 | 29.6 | 28.8 |
| Sulfur: wt % | 2.74 | 0.18 | 0.37 |
| Distillation, ASTM D86: ° F. vacuum: 10 MM | | | |
| EP | 1005 | 976 | 976 |
| 5% | 615 | 580 | 578 |
| 10% | 649 | 614 | 616 |
| 20% | 695 | 662 | 668 |
| 30% | 730 | 695 | 710 |
| 40% | 764 | 740 | 745 |
| 50% | 796 | 774 | 776 |
| 60% | 831 | 805 | 809 |
| 70% | 864 | 843 | 842 |
| 80% | 902 | 878 | 881 |
| 90% | 943 | 925 | 927 |
| 95% | 964 | 949 | 959 |

Table 10 shows the characteristics of the blend of the furnace oil, gas oil and the light lubricating oil extract feedstock of Tables 5 and 6 and also shows the characteristics of the effluent from the hydrodesulfurization reactor when this feedstock blend is hydrodesulfurized at a space velocity of about 0.8 and 1.6.

TABLE 10

| HYDRODESULFURIZING OF A BLENDED CHARGE STOCK | | |
|---|---|---|
| Charge: Blend of 35 wt % Kuwait furnace oil, 53 wt % Kuwait gas oil, 12 wt % Kuwait lube oil extract | | |
| Average Reactor Temperature: ° F. | 680 | 680 |
| Reactor Pressure: psig | 937 | 939 |
| LHSV: vol/hr/vol | 1.64 | 0.78 |

TABLE 10-continued

| HYDRODESULFURIZING OF A BLENDED CHARGE STOCK | | | |
|---|---|---|---|
| Gas Rate: SCF/Bbl | | 1907 | 2000 |
| $H_2$ Content of Reactor Gas: vol % | | 79.4 | 80.3 |
| Hydrogen Consumption: SCF/Bbl (Unit) | | 370 | 463 |
| Total Liquid Product Yield: wt % of fresh feed | | 97.39 | 96.26 |
| Total Product Inspections | Feed | | |
| Gravity: ° API | 26.3 | 30.3 | 31.9 |
| Sulfur: wt % | 2.68 | 0.28 | 0.14 |
| Distillation, ASTM D86: ° F. Vacuum: 10 MM | | | |
| EP | 987 | 961 | 958 |
| 5% | 509 | 497 | 489 |
| 10% | 543 | 528 | 521 |
| 20% | 589 | 574 | 574 |
| 30% | 629 | 610 | 603 |
| 40% | 662 | 643 | 634 |
| 50% | 698 | 673 | 667 |
| 60% | 737 | 710 | 702 |
| 70% | 781 | 757 | 750 |
| 80% | 832 | 811 | 811 |
| 90% | 900 | 876 | 876 |
| 95% | 942 | 921 | 921 |

The present hydrosulfurization process can be advantageously applied to a situation where a relatively low-boiling, low sulfur-containing hydrocarbon stream from a first crude source, such as furnace oil boiling between 400° and 600° or 650° F., which does not meet commercial sulfur requirements (which is 0.2 weight percent sulfur, or lower) and therefore would require desulfurization in a first reactor while in the same refinery a relatively high-boiling, high sulfur-containing gas oil from a second crude source having a volume average boiling point above 750° F. is hydrodesulfurized in a second reactor. In accordance with the present invention, a relatively high boiling portion of the furnace oil, after separation from the furnace oil, is blended with the gas oil to produce a total hydrodesulfurization feed oil blend having a volumetric average boiling point of at least 700° or 750° F., but lower than the original volume average boiling point of the gas oil. Sufficient high boiling high sulfur-containing material is separated from the furnace oil for blending with the gas oil that the remaining light furnace oil is sufficiently low in sulfur to meet commercial domestic sulfur specifications (below 0.2 weight percent) without requiring passage through a hydrodesulfurization zone. In this manner, the boiling range of the heavy gas oil is advantageously broadened to impart a synergistic sulfur-removal effect to it, while no desulfurizer is required for the light furnace oil, thereby avoiding construction of a furnace oil desulfurizer.

Similarly, the present invention can be applied to combining an entire light oil stream (such as furnace oil) with an entire gas oil stream (boiling between 600° or 650° and 1050° F.) to produce a wide-boiling blended total stream having a high synergistic effect which is processed in a single reactor, instead of charging the separate streams to separate reactors because the lighter oil is destined for use as a furnace oil whereas the heavier gas oil is destined for use as an FCC feed. If desired, the hydrodesulfurized blend can be charged in its entirety to the FCC riser or it can be fractionated and the furnace oil can be used as a fuel oil and the gas oil only can be charged to the FCC riser. The blend of the two streams should have an average boiling point of at least 700° or 750° F.

Additional tests were conducted to illustrate the hydrodesulfurization of blends of oils to show the effect upon sulfur removal in the lower boiling portion of the blend. In these tests a blend of a naphtha range feed with a furnace oil feed was hydrodesulfurized with a catalyst comprising nickel-cobalt-molybdenum on alumina. The results of the tests are shown in FIG. 2.

Figure 2:
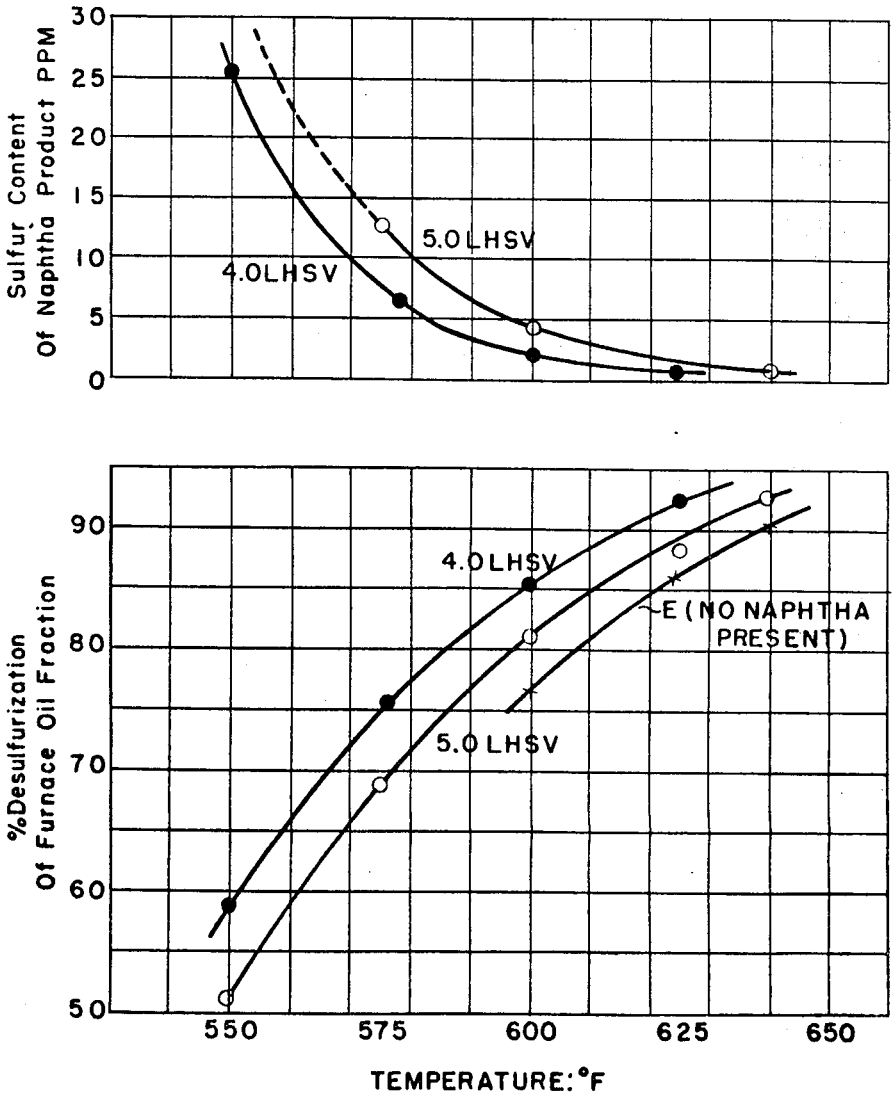

FIG. 2 not only shows that the sulfur content in the lighter portion of the feed, that is the naphtha, is much lower (0.04 weight percent or 400 ppm) as compared to the sulfur content in the furnace oil (1.02 weight percent) but also that the sulfur in the naphtha oil portion of the blend at any given hydrodesulfurization temperature is removed relatively more easily than the sulfur of the heavier furnace oil fraction. FIG. 2 compares the sulfur content of the naphtha portion of the effluent and the furnace oil portion of the effluent when operating at space velocities of 4.0 and 5.0, respectively. Line E of FIG. 2 shows the level of sulfur removal that would occur in the furnace oil at 5 LHSV if the naphtha was not present in the blend. Line E shows that the naphtha exerts a synergistic effect upon sulfur removal of the heavier furnace oil portion of the feed.

Data were also taken by hydrodesulfurizing a heavier naphtha alone, without the presence of furnace oil, and these data tend to show that the presence of the heavier furnace oil inhibits removal of sulfur from the lighter naphtha portion of the blend. Therefore, the mechanism of the synergistic effect upon reaction rate is apparently that the lighter portion of the blend advantageously tends to increase sulfur removal from the heavier portion of the blend while the heavier portion of the blend tends to inhibit sulfur removal from the lighter portion of the blend and the net effect is an overall enhancement of sulfur removal due to blending. The important feature of the present invention is that the presence of lighter material assists removal of sulfur from the heavier material. This fact is important because, as noted above, it is the sulfur in the heavier material which is not easily vaporized and which is therefore present in the coke in any subsequent FCC reaction and it is the coke sulfur which ultimately ends up as sulfur dioxide, which is an atmospheric pollutant because it cannot be removed from FCC regenerator flue gases by amine scrubbing. On the other hand the sulfur present in the lighter portion of the feed which is easily vaporized and cracked in the FCC riser is largely removed in the FCC riser as hydrogen sulfide which can be scrubbed from riser off-gases with an amine, such as diethanolamine, and is thereby prevented from polluting the atmosphere. Furthermore, it was shown above that in any hydrodesulfurization process sulfur removal from the light feed material occurs more easily and to a greater extent than sulfur removal from a heavier material present in the hydrodesulfurizing feed whereby a smaller percentage reduction in sulfur dioxide is observed than the percent reduction in total sulfur in the feed to an FCC unit.

Table 11 shows the characteristics of the naphtha in the feed of the blend of FIG. 2 and also shows the characteristics of the naphtha portion in the product from the hydrodesulfurization process of FIG. 2.

TABLE 11

INSPECTION DATA FOR $C_5$-380° F. NAPHTHA PRODUCTS FROM DESULFURIZATION AT A FEED RATE OF 5.0 LHSV

| Charge | | $C_5$-680° F. Distillate |
|---|---|---|
| Operating Conditions | | |
| LHSV: vol/hr/vol | | 5.0 |
| Reactor Pressure: psig | | 700 |
| Average Reactor Temperature: ° F. | | 640 |
| Gas Rate: SCF/B | | 1200 |
| $H_2$ Content: % | | 90 |
| | Naphtha Fraction in Feed | $C_5$-380° F. Distillate from Desulfurizer |
| Inspections | | |
| Gravity: D287: ° API | 64.7 | 62.9 |
| Distillation, D86: ° F. | | |
| Over Point | 103 | 117 |
| End Point | 366 | 376 |
| 5% | 137 | 151 |
| 10% | 153 | 166 |
| 20% | 177 | 189 |
| 30% | 199 | 209 |
| 40% | 221 | 229 |
| 50% | 240 | 249 |
| 60% | 258 | 267 |
| 70% | 273 | 287 |
| 80% | 295 | 306 |
| 90% | 315 | 326 |
| 95% | 328 | 341 |
| Sulfur, ppm by weight | 400 | <1 |

As shown in Table 11 and as shown in FIG. 2 at about a hydrodesulfurization temperature of 640° F. the sulfur content in the naphtha portion of the hydrodesulfurization product is about 1 ppm. It is noted that the data points in FIG. 2 for the naphtha product show that less severe conditions did not produce a 1 ppm sulfur naphtha product when the naphtha was present in a blend with furnace oil.

Table 12 shows the results of a test treating a higher boiling naphtha in an unblended condition with a similar catalyst to hydrodesulfurize the naphtha at conditions of 300 psig, 600° F., 5.6 LHSV and 300 SCF/B of hydrogen. Each one of these test conditions is much less severe than the comparable condition employed in the hydrodesulfurization reaction illustrated in Table 11. The characteristics of the unblended naphtha feed and the unblended naphtha hydrodesulfurization product of these tests are illustrated in Table 12.

TABLE 12

HYDRODESULFURIZATION OF A LOW SULFUR CONTENT VIRGIN NAPHTHA AT LOW HYDROGEN PARTIAL PRESSURE

| | Charge | |
|---|---|---|
| Operating Conditions | | |
| Temperature: ° F. | | 600 |
| Pressure: psig | | 300 |
| Space Velocity: vol/hr/vol | | 5.6 |
| Gas Circulation: SCF/B | | 300 |
| % $H_2$ | | 84.6 |
| Inspections | | |
| Gravity: ° API | 48.0 | 47.8 |
| Sulfur: ppm | 400 | 1 |
| Distillation: ASTM D86 | | |
| IBP: ° F. | 271 | 270 |
| EP: ° F. | 411 | 411 |
| 10% at ° F. | 297 | 302 |
| 30% | 315 | 318 |
| 50% | 331 | 333 |
| 70% | 346 | 349 |
| 90% | 373 | 373 |

Table 12 shows that under much less severe hydrodesulfurizing conditions, when employing an unblended naphtha feed the sulfur content of the product was reduced to about the same level, i.e. about 1 ppm, as when the naphtha was treated in the presence of furnace oil but under much more severe conditions, indicating that the presence of a heavier material with the naphtha feed tended to inhibit sulfur removal in the naphtha portion of the bleed. As noted above and as shown in FIG. 2, in a blended condition the naphtha required the full reaction severity indicated to achieve the 1 ppm sulfur level. These data indicate that although according to the synergistic sulfur removal reaction effect of the present invention the presence of a lighter material enhances the rate of sulfur removal of the heavier portion of the blend, at the same time the sulfur removal from the lighter portion of the blend tends to be inhibited.

Figure 3:
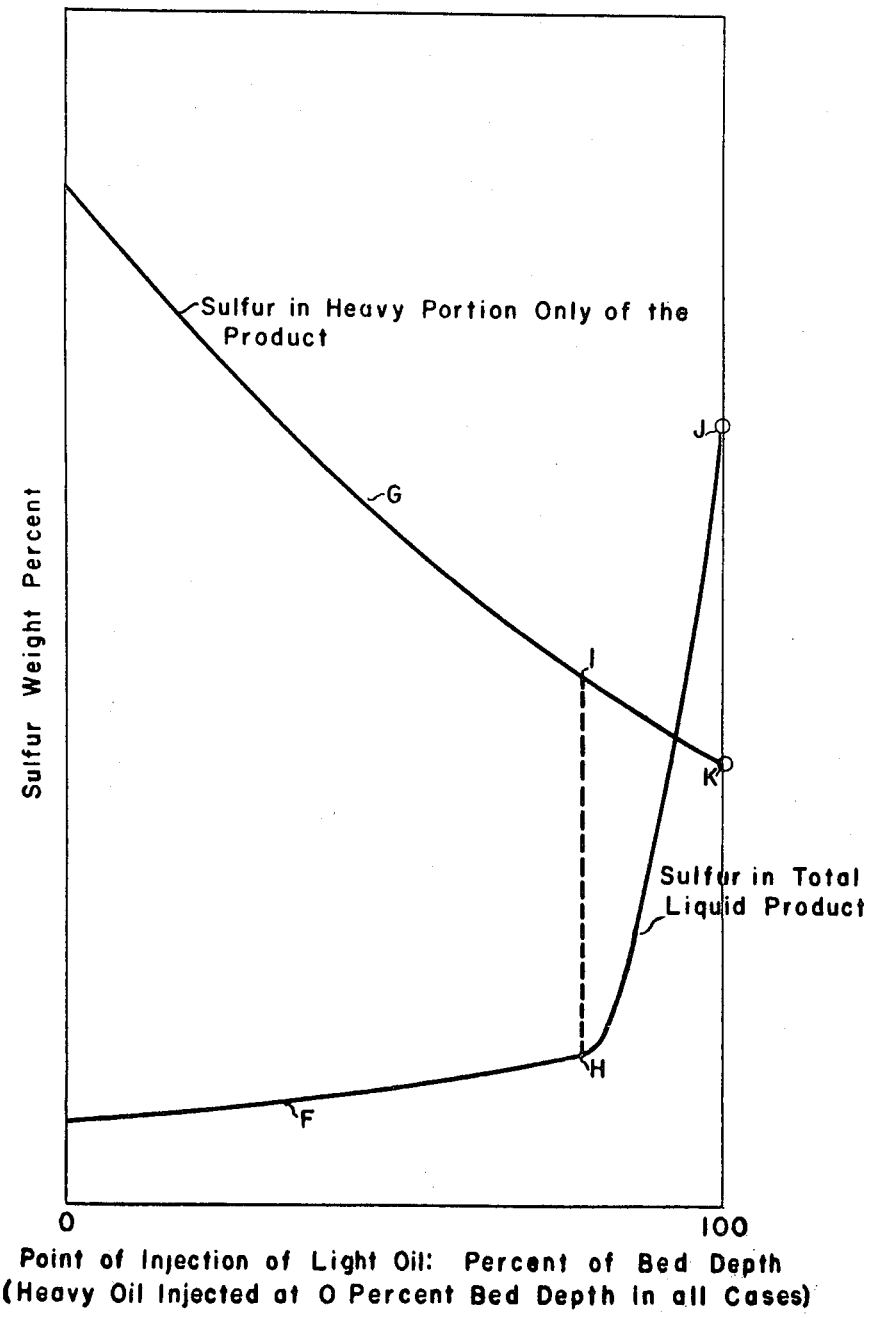

A variation of the present invention is presented in the process illustrated in FIG. 3 wherein the synergistic effect of this invention can be partially foregone with advantage. FIG. 3 illustrates the degree of sulfur removal when a blend of two different feed portions having adjacent or overlapping boiling ranges including a light portion (such as a furnace oil having a boiling range between 400° and 650° F.) and a heavy portion (such as gas oil having a volume average boiling point about 750° F.) are added to a hydrodesulfurization reactor employing the same type of nickel-cobalt-molybdenum on alumina catalyst employed in the prior tests, together with hydrogen, in downflow reactor operation over a stationary bed of compacted catalyst particles. In the system of FIG. 3, a virgin oil which has a relatively high boiling range, and a relatively high sulfur content, is the heavy portion of the blend and the effluent sulfur content of this fraction only of the total product is indicated by line G in FIG. 3.

Line F of FIG. 3 illustrates the sulfur content in the total product when a virgin oil having a lower boiling range (volume average boiling point below 750° F.) and having a lower sulfur content is combined with the heavy oil (volume average boiling point above 750° F.). In the abscissa of the curve of FIG. 3 it is shown that when the total blend employing the light oil together with the heavy oil is charged to the inlet of the reactor (0 percent of bed depth), the sulfur in the total product is at its lowest value while the sulfur in the heavy oil portion distilled out of the total product (line G) is at its highest value.

Line G represents the sulfur content in the heavy oil distilled cut of the total product including both light oil and heavy oil, except that the terminus of line G, indicated by point K, indicates the sulfur content of the heavy gas oil effluent when the heavy oil is charged through the entire catalyst bed without any of the light oil. Point K shows that the total absence of light oil permitted maximum desulfurization of the heavy oil because the heavy oil did not have to compete with the light oil for catalyst sites. Therefore, although the light oil provides the synergistic effect of this invention, it also inherently produces a negative dilution effect and the following discussion of FIG. 3 illustrates a system wherein the synergistic effect of the light oil can be partially obtained while holding to a minimum its negative effect of dilution of the heavy oil.

Referring to FIG. 3, the unusual feature is observed that very close to a minimum level of sulfur content in the total product, as indicated by point H, is achieved if the heavy oil portion of the total blend only is added to the top of the catalyst bed and permitted to pass through about 80 percent of the catalyst bed undiluted by light oil while the light oil portion of the total blend only is added to the reactor at a point about 80 percent downwardly into the bed depth. The total blend has a volume average boiling point of at least 750° F. FIG. 3 shows that when the heavy oil portion of the blend is added with hydrogen at the top of the catalyst bed and the light oil is added at a point about 90 percent downwardly into the bed depth, the sulfur content in the heavy oil fraction of the product and in the total product is about equal, since this is the point at which curves F and G cross. FIG. 3 further shows, that if the light oil portion (having a volume average boiling point below 750° F.) of the blend is not added to the hydrodesulfurization reactor but the heavy oil alone (having a volume average boiling point about 750° F. ) passes through the entire catalyst bed having access to catalyst sites which is uninhibited by the presence of the light oil, the heavy oil portion itself is desulfurized to the greatest extent (point K). FIG. 3 also shows that if the light oil in a nondesulfurized condition is blended with the hydrodesulfurized heavy gas oil effluent, the sulfur content of the total product is a maximum, and is at an unacceptably high value (point J), which indicates a highly inefficient mode of operation, and may not even constitute 80 percent sulfur removal from the total feed including both high and low boiling portions. Therefore, according to FIG. 3, the most advantageous mode of operation for sulfur removal from the heavy oil is to add the heavy oil at the top of the reactor bed and not to add light oil to the reactor at all. But if the light oil is ultimately to be blended with the heavy oil, or if the light oil must be desulfurized, FIG. 3 indicates the most economical mode of operation is to add the light oil fraction to a point at about 80 percent downwardly in the bed depth so that the sulfur content in the total effluent is nearly a minimum, as indicated by point H, while the sulfur content in the heavy oil portion only of the total product nearly approaches its minimum value at point K (see point I). Although this mode of operation gives up the synergistic effect contributed by the light portion along the top 80 percent of the catalyst bed, it does have the advantage of not diluting the refractory sulfur-containing molecules in the heavy fraction along the top 80 percent of the bed depth and thereby permitting greater sulfur removal from the heavy fraction only while employing a smaller reactor and a smaller quantity of catalyst and thereby achieving a large economic advantage while giving up only a small advantage in terms of the sulfur content in the total product.

If the synergistic effect of this invention is the only consideration, it would be advantageous to charge the light oil portion to the top of the catalyst bed together with the heavy oil portion so that the light oil portion can exert a maximum sulfur removal synergistic effect upon the heavy portion of the total product. However, by adding the light portion late to the reactor an additional advantage is achieved in that it is easier for the process to achieve 80 percent total desulfurization with a limited amount of catalyst and without increasing the temperature differential between the 10 and 90 percent distillation points of the total feed more than 20° F., although the temperature drop of the 90 percent point is more easily lowered at least 10° or 15° F., indicating enhanced sulfur removal from the high-boiling portion and rendering the high-boiling high-sulfur compounds more easily vaporizable in a subsequent FCC riser, to reduce sulfur dioxide formation. Whatever mode of operation is employed the entire effluent can be charged to the FCC step or the effluent can be distilled to recover light oil for use as furnace oil, and heavy oil, for charging the FCC riser. Points H and I of FIG. 3 indicate that operation of the hydrodesulfurization reactor by injecting the light portion at about 80 percent of the bed depth represents an ideal compromise between the synergistic and dilution effects of the light oil in that the sulfur level in the total product is almost a minimum (Point H) while the sulfur level in the heavy portion only of the product is also close to a minimum (Point I). Injection of the light oil at greater than 80 percent of the bed depth improves sulfur removal from the heavy portion of the product only slightly while greatly increasing the sulfur level in the total product. FIG. 3 illustrates results with a particular feed blend but with other feed blends the optimum point of injection of the light oil (point H) might be elsewhere in the bed, e.g. at 50, 60, 70 or even at a deeper percentage of the bed depth.

Figure 4:
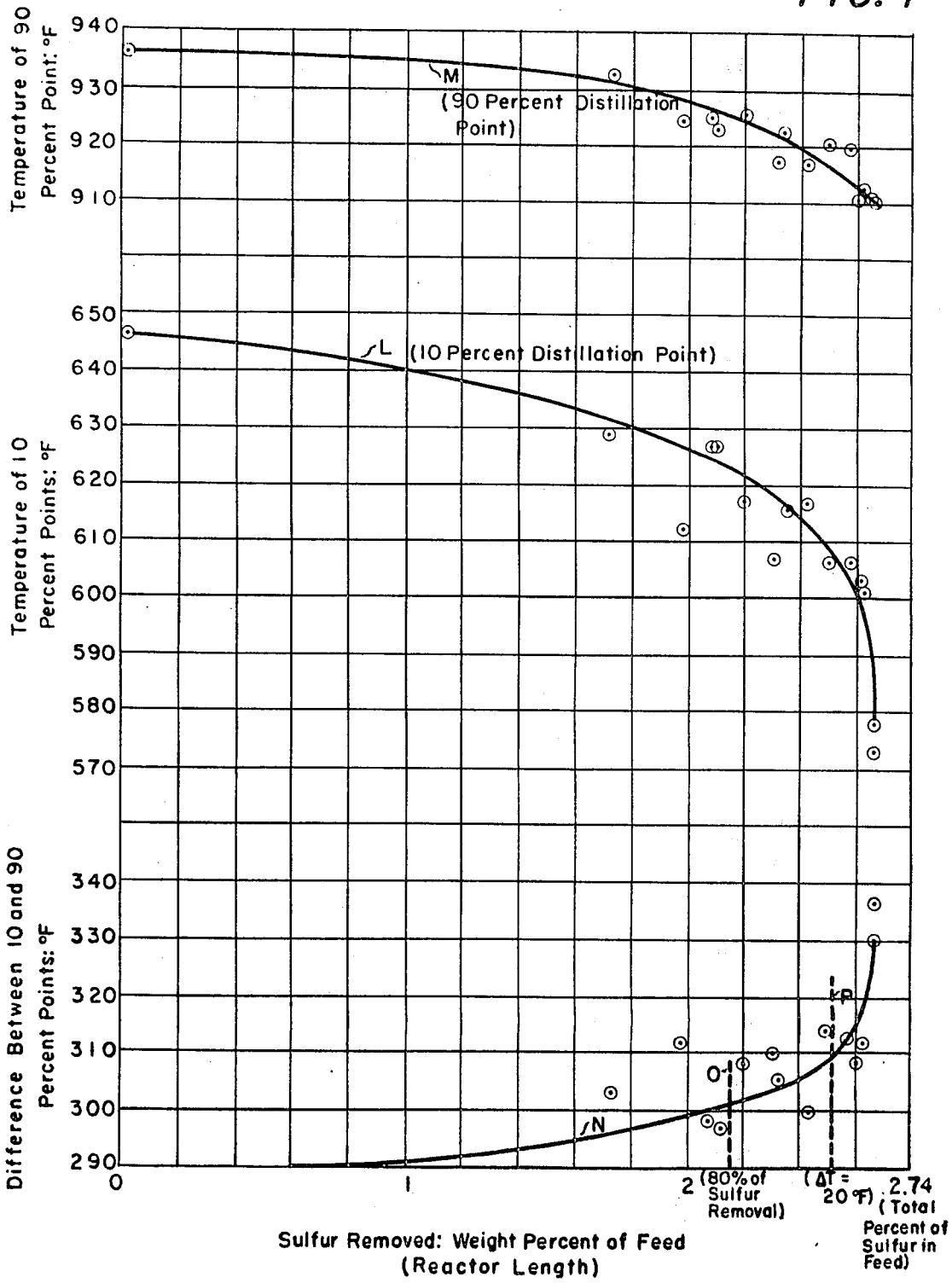

An especially important feature of the present invention is illustrated in FIG. 4. FIG. 4 represents the variation of the 10 percent distillation point and the 90 percent distillation point in a feed oil during a hydrodesulfurization process of the present invention. Suitable feed oils for this invention include the overhead of atmospheric or vacuum distillations and include oils in the furnace oil and gas oil boiling ranges. The 90 percent distillation point represented by line M in FIG. 4 is particularly important because the 90 percent distillation point material represents the heavy material in the system in which the sulfur content is richest, from which it is most difficult to remove sulfur, and which contains the sulfur which is present in the coke of a subsequent FCC riser which ends up as sulfur dioxide in an FCC regeneration operation. A significant drop in the 90 percent distillation point, i.e. at least 10°, 15°, 20° F., or more, is tangible evidence of significant removal of sulfur from the heaviest material in the feed stream. Therefore, it is important to a hydrodesulfurization process of the present invention that a significant drop occur in the 90 percent distillation curve of a feed moving through a hydrodesulfurization reactor. In the process of FIG. 4, the feed and hydrogen flow downwardly over a fixed, stationary bed of nickel-cobalt-molybdenum on alumina catalyst particles.

The line L in FIG. 4 represents the drop in temperature of the 10 percent distillation point. The 10 percent distillation point drops more readily than the 90 percent distillation point because it represents the accumulation of all light components produced due to either sulfur removal or hydrocracking of higher boiling materials. The removal of sulfur from the 10 percent distillation point material of the feed occurs most readily because, as shown in Table 1, above, the desulfurization reaction rate constant is low in high boiling materials but increases exponentially as the boiling point of the sulfur-containing component decreases. However, it is noted that the 10 percent point should not drop more than 40° or 50° F. At point P, which represents the hydrocracking limit of the process of FIG. 4, it is noted that the 10 percent distillation temperature dropped almost 40° F. and is in a region of a further very sharp drop upon passage over any additional catalyst.

The presence of a significant quantity of sulfur in the hydrocarbon in a hydrodesulfurization system acts as an inhibitor against appreciable hydrocracking in the hydrodesulfurization system. Hydrocracking is indicated by a very rapid drop in the 10 percent distillation point. Hydrocracking, which is the severance of carbon-carbon bonds, as contrasted to sulfur removal by severance of carbon-sulfur bonds, is highly undesirable in the present invention because it represents a needless consumption of hydrogen in the preparation in the feed for an FCC process wherein hydrogen is not added and cracking occurs without consuming hydrogen. Therefore, the consumption of hydrogen to accomplish cracking is an economic waste in the preparation of a feed for an FCC process. Furthermore, a gasoline range components produced by hydrocracking have a lower octane number due to the saturation of olefins caused by the presence of hydrogen. Olefins are known gasoline octane-improvers. On the other hand, gasoline produced in a zeolitic FCC riser in the absence of added hydrogen is rich in olefins and these olefins contribute to a high octane number gasoline product. One means of inhibiting hydrocracking is to use recycle hydrogen as a coolant or quench to be injected at various positions in the hydrodesulfurization reactor to accomplish cooling. It is advantageous to employ a single hydrodesulfurization reactor chamber, with one or a plurality of separated beds, with the total feed hydrocarbon blend introduced at the reactor inlet and with the total hydrogen either added at the reactor inlet or divided and added both to the reactor inlet and also at several positions along the length thereof, preferably between catalyst beds, to provide a quenching effect.

A further reason for avoiding extensive hydrocracking in the hydrodesulfurization process is that the hydrodesulfurization operation of the present process is designed to accomplish a synergistic effect in sulfur removal between the light (represented by the 10 percent distillation point of FIG. 4) components and the heavy (represented by the 90 percent distillation point of FIG. 4) components in the feed blend moving through the hydrodesulfurization reactor. As explained above, this synergistic effect in the sulfur removal reaction between high reaction rate components and low reaction rate components can be translated into a savings in catalyst required per barrel of feed and also a savings in hydrogen consumed per barrel of feed due to the smaller catalyst bed. If the feed traveling through the reactor is permitted to remain in the reactor sufficiently long to permit extensive hydrocracking at the reactor outlet region, this is evidence that the catalyst bed is excessively great in length in relation to its sulfur-removing function and therefore the catalyst savings that could be achieved due to the synergistic effect of this invention if the reaction were limited essentially to sulfur removal is rendered innocuous, to say nothing of resulting wasteful hydrogen consumption.

Since it is an objective of the present invention to remove as much sulfur as possible from the 90 percent distillation point components of the feed, as evidenced by a drop in the 90 percent distillation point of the material traveling through the reactor, sufficient catalyst should be present to permit as great a drop as possible in the 90 percent distillation point. However, in order not to exceed the range of the synergistic effect advantage of the present invention, the amount of catalyst present, and therefore the depth of the reactor bed, should be limited to a range such that the sulfur-level does not become sufficiently low that the inhibitory power of sulfur against extensive hydrocracking is avoided. This objective is realized by a limitation in the drop of the 10 percent distillation point of the material traveling through the reactor. We have found that the present invention is best performed to accomplish reduction in the 90 percent distillation point (representing the most desirable sulfur removal) without encountering an excessive reduction in the 10 percent distillation point (representing excessive hydrocracking) by employing a catalyst bed of sufficient depth so that at least 80 percent of the sulfur is removed from the hydrocarbon feed while permitting the temperature difference between the 90 percent and the 10 percent distillation points to increase but not to increase by an amount exceeding 10°, 15° or 20° F. It is important that at least 80 percent of the sulfur be removed, because line M of FIG. 4 shows that in the removal of only 50 or 60 percent of the total sulfur in the feed, very little effect upon the 90 percent distillation point is apparent, while line L shows most of the initial sulfur removal was from the lighter material.

Referring again to FIG. 4, line N illustrates the increase in temperature differential between the 10 percent distillation point and the 90 percent distillation point of the feed as it travels through the reactor. At position O on line N, 80 percent of the total sulfur in the feed has been removed, satisfying the requirements of this invention. At the same time, the 90 percent distillation point has dropped at least 10° F., indicating a significant amount of the sulfur removal was from the most refractory sulfur, which would be likely to be present in the coke formation of a subsequent cracking unit. At position O, the temperature differential between the 10 percent point and the 90 percent has not yet increased by 20° F., also satisfying the requirements of this invention. It is not until position P on line N has been reached that the increase in temperature differential between the 10 percent and 90 percent distillation points just reaches 20° F. It is noted that line N begins to move abruptly upwardly in an exponential manner once the 20° F. increase is achieved. It is at this point that the sulfur level becomes so low that the amount of sulfur in the feed is inadequate to effectively inhibit hydrocracking so that hydrocracking begins to occur at an excessive and undesirable rate. As already stated, hydrocracking at an excessive and undesirable rate is to be avoided because it results in an economic waste of hydrogen and because it produces gasoline having a lower octane number than the gasoline that can be produced in a subsequent FCC riser operation in the substantial absence of added hydrogen. The reaction of the present invention is terminated at least at the catalyst depth (reactor length) represented by point P. More particularly, the catalyst depth should be in the region represented between the points O and P, i.e. the bed depth is great enough to accomplish at least 80 percent sulfur removal, with a drop in the 90 percent distillation point of at least 10° F., with an increase in temperature differential between the 10 percent and 90 percent distillation points but without the temperature differential increase exceeding 20° F. and without the 10 percent point dropping more than 40 or 50° F. When the bed depth is between the points indicated by O and P of FIG. 4, the catalyst savings due to the synergistic sulfur removal effect of the present invention is realized. A savings in reaction time and in prevention of excessive hydrocracking is also realized. If the catalyst bed depth exceeds that represented by point P, the total sulfur removal is greater but the catalyst economy feature of this invention becomes valueless because insufficient sulfur remains in the stream for effective synergism in sulfur removal, as evidenced by the fact that the additional catalyst contributes relatively more heavily to hydrocracking reactions rather than to hydrodesulfurization reactions. The onset of excessive hydrocracking therefore indicates the synergistic reaction effect of this invention is essentially terminated. Therefore, the catalyst economy advantage of the present invention is a transient advantage which becomes useless when the increase temperature differential between the 10 and 90 percent distillation points exceeds 20° F. Preferably, the increase in the temperature differential can be below 15° F. It is noted that further widening of the boiling range of the feed of FIG. 4 by addition of a furnace oil would permit a higher degree of desulfurization of the gas oil than that indicated by point P without excessive hydrocracking.

Figure 5:
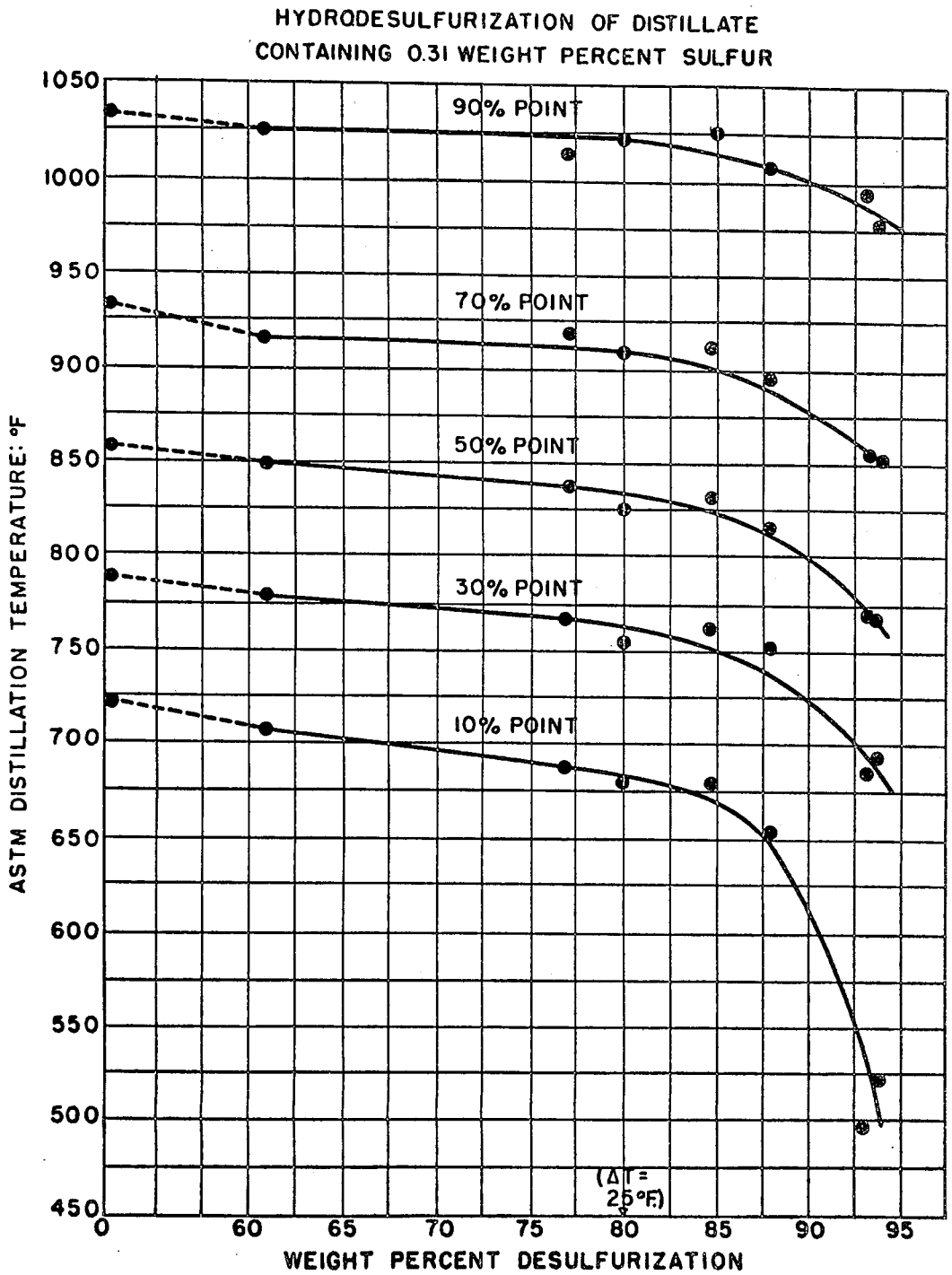

It has already been noted that the presence of sulfur in the feed material must be sufficiently great to inhibit hydrocracking. While FIG. 4 indicates that the feed sulfur content is 2.74 weight percent, FIG. 5 illustrates the hydrodesulfurization of a feed containing only 0.31 weight percent sulfur. FIG. 5 shows the variation in the 10, 30, 50, 70 and 90 percent distillation points (the average of which represents the volume average boiling point of a hydrocarbon stream) with increasing levels of desulfurization with a feed containing this low level of sulfur content. Referring to FIG. 5, it is seen that at 80 percent desulfurization of the feed the temperature differential between the 10 percent and the 90 percent distillation points has increased 25° F., as compared to the feed, which is beyond the permissible 20° temperature differential at 80 percent desulfurization in accordance with this invention. FIG. 5 shows that the temperature differential had already reached 20° F. when only 75 percent of the feed sulfur was removed. Therefore, the feed illustrated in FIG. 5 has too low a level of sulfur to be included within the present invention. The sulfur level of such a feed is so low that it cannot adequately inhibit hydrocracking with its attendant expense in hydrogen consumption while it accomplishes desulfurization. As noted earlier, it is desired to reserve cracking for the subsequent FCC unit. Furthermore, the level of sulfur in the feed of FIG. 5 is so low that the requirement for the synergistic sulfur removal effect of the present invention is not as important as with the feed illustrated in FIG. 4. Moreover, the low feed sulfur level shown in FIG. 5 indicates that the feed will not be a major source of sulfur dioxide contamination in a subsequent regeneration unit of a downstream FCC riser cracker.

Figure 6:
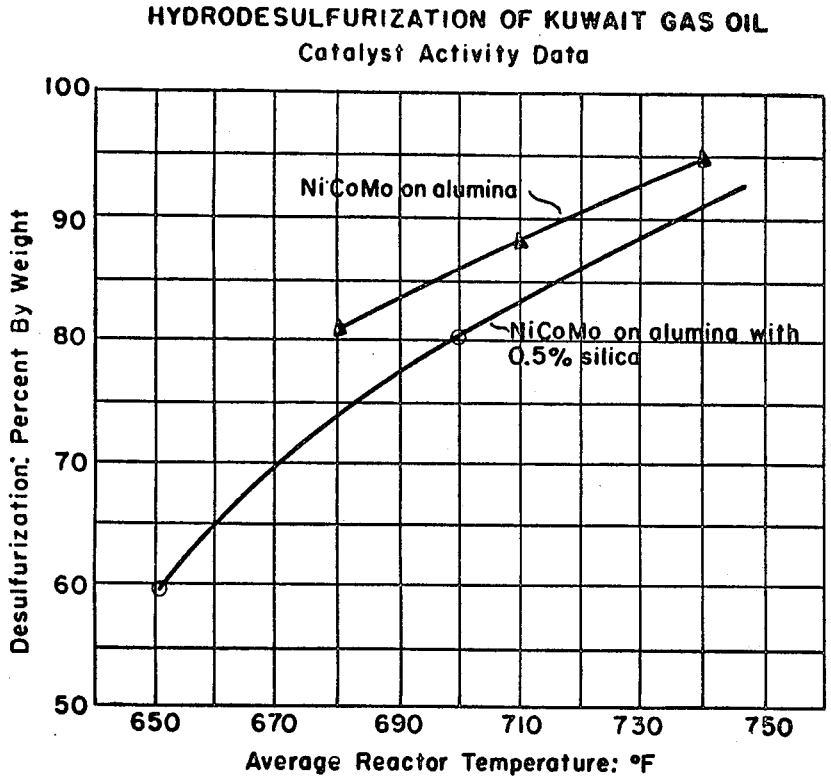

FIG. 6 presents data to illustrate the importance to the hydrodesulfurization process of the present invention of avoiding a catalyst containing silica. The data shown in FIG. 6 were taken by passing a Kuwait gas oil having 2.93 weight percent sulfur, an ASTM 10 percent point of 689° F. and an ASTM 90 percent point of 1011° F., downflow over a bed of 1/16 inch nickel-cobalt-molybdenum on alumina catalyst particles at a pressure of 1000 psig, 2000 SCF/B of 70 to 75 percent hydrogen, a LHSV of 2.0, while scrubbing the recycle gas with NaCaOH. In the upper curve of FIG. 6, the alumina support is essentially silica-free while in the lower curve of FIG. 6 the catalyst is promoted with 0.5 weight percent silica. It is seen from FIG. 6 that at all temperatures, the promotion of the catalyst with silica results in a lower weight percent desulfurization of the feed oil. The data of FIG. 6 show the importance of employing a hydrodesulfurization catalyst having less than 0.5 weight percent silica and preferably of employing catalyst containing less than 0.25 weight percent silica or even 0.1 weight percent silica, or less.

The present invention is to be distinguished from prior art processes in which a cracking feed is hydrogenated or hydrodesulfurized in advance of a cracking operation in order to accomplish a hydrogen donation effect in the cracking operation. Hydrogen donation, is a direct transfer of hydrogen from certain partially or completely saturated ring compounds, such as aromatics or naphthenes, to other refractory compounds during cracking without the addition of free hydrogen in order to render the refractory compounds less refractory. It occurs during a cracking operation which permits sufficient residence time for such hydrogen donation to occur. Hydrogen donation has the overall effect of rendering the feed less refractory even though no free hydrogen is added to the cracking system. In such hydrogen transfer processes, hydrogen is added to easily hydrogenated aromatic or naphthenic compounds in a prehydrogenation stage and then during cracking the hydrogen is transferred directly to a more refractory, hydrogen deficient compound to render the more refractory compound more susceptible to cracking. However, as stated, such hydrogen donation requires sufficient residence time for its occurrence. The cracking operation of the present invention occurs with a highly active zeolite cracking catalyst at a residence time of less than five seconds, preferably less than 2 or 3 seconds, and occurs with hydrocarbon feed and regenerated or fresh catalyst flowing concurrently upwardly through the reactor at about the same velocity, without permitting catalyst bed formation (whereby backmixing of hydrocarbon occurs) anywhere in the reaction flow path. Such a riser cracking process is described in U.S. Pat. No. 3,617,512, which is hereby incorporated by reference. In FIG. 3 of U.S. Pat. No. 3,617,512, chamber 2 could comprise a hydrodesulfurization reactor of this invention. The residence time in the cracking riser is preferably three seconds or less and can be one or two seconds or less. The top of the riser is capped and provided with lateral exit slots to insure immediate disengagement of reactants and catalyst at the riser exit, thereby preventing overcracking of gasoline after vapors and catalyst leave the riser. To illustrate the absence of hydrogen donation in a cracking riser of the present invention, a cracking riser rest is illustrated in Table 13. As shown in Table 13, two tests were conducted, one of which employed 100 percent cyclohexane (the saturated aromatic) as feed and the other employing a 2:1 mole ratio of cyclohexane to pentane-2, pentene-2 constituting the hydrogen-deficient compound. The cyclohexane-pentane-2 blend had an impurity of 0.16 weight percent isopentane.

TABLE 13

| Feed | 100% Cyclohexane | | 2:1 Mole Ratio of Cyclohexane/ Pentene-2 with 0.16 wt % $iC_5$ Impurity |
|---|---|---|---|
| Operating Conditions | | | |
| Riser Temperature: ° F. | ← | 1000 | → |
| Contact Time: Sec. | ← | ~1.2 | → |
| Cat/Oil Ratio: wt/wt | ← | 8.0 | → |
| Regen.Cat.Temp: ° F. | ← | 1115 | → |
| Carbon on Catalyst: wt % | ← | 0.45 | → |
| Feed Temp.: ° F. | ← | 80 | → |
| Yields: wt % FF | | | |
| Unconverted Feed | 98.75 | | 99.24 |
| Isopentane | 0.04 | | 0.14* |
| Normal Pentane | 0.00 | | 0.00 |
| Isobutane | 0.72 | | 0.11 |
| Propane | 0.00 | | 0.03 |
| Acetylene | 0.15 | | 0.16 |
| Hydrogen | 0.34 | | 0.32 |
| TOTAL | 100.00 | | 100.00 |

*Less $iC_5$ yield than was present as a feed impurity

Comparing the two tests shown in Table 13, at the very low residence time of the riser cracking reaction it is seen that hydrogen transfer from the cyclohexane to the pentene-2 was so low that there was a net loss of hydrogen from the pentene-2 rather than a net gain in that the yield of the second test contained only 0.14 weight percent total pentanes, which is lower than the 0.16 weight percent isopentane impurity present in the feed. Therefore, no hydrogen donation occurred from the cyclohexane to the pentene-2. It is noted that the cyclohexane and the pentene-2 are both materials boiling within the gasoline boiling range. Materials boiling within the gasoline boiling range are much more refractory than materials boiling above the gasoline range. Due to this refractoriness, both tests illustrated in Table 13 showed that essentially no cracking occurred during the tests. This absence of cracking allows the data to illustrate quite pointedly that under the standard cracking conditions of this invention which are adapted for cracking material boiling above the gasoline range down to the gasoline range with minimal overcracking of gasoline range material itself, no hydrogen transfer occurs.

The zeolite riser cracking conditions and system (known as FCC or fluid catalytic cracking) of this invention do not employ added hydrogen and incorporate the cracking conditions disclosed in U.S. Pat. No. 3,617,512. The cracking temperature can be 900° to 1100° F., or more. The preferred temperature range is 950° to 1050° F. The reaction pressure can vary widely and can be, for example, 5 to 50 psig, or preferably 20 to 30 psig. The maximum residence time is 5 seconds, and for most charge stocks will be 0.5 to 2.5 seconds. A suitable weight ratio of catalyst to total oil charge is 4:1 to about 12:1 or even 25:1. The velocity of catalyst and oil through the riser can be 25 to 75 feet per second. There is substantially instantaneous vaporization of oil upon contact with the hot regenerated catalyst. Catalyst regeneration can occur at 1,240° or 1,250° F. or more to reduce the level of carbon on the regenerated catalyst from the range of about 0.6 to 1.5 to about 0.05 to 0.3 percent by weight. Riser space velocity should not be below 35 and should preferably be above 100 and can be 400 or 500, or more, based on hydrocarbon feed and instantaneous catalyst inventory in the riser. The density at the riser inlet can be below 4 or 4.5 pounds per cubic foot. There is no catalyst bed formation anywhere in the zeolite catalyst reaction flow path once regenerated catalyst contacts hydrocarbon feed until disengagement between the two occurs and the cracking reaction is terminated.

A series of tests were performed to determine in various cracking systems the effect upon the ratio of FCC gasoline to total FCC conversion wherein the FCC feed boils above the gasoline range. Tests are presented to illustrate the effect upon this ratio of the use of a zeolite as compared to a nonzeolite-containing catalyst. The results of these tests showed that a zeolite-containing catalyst produced a considerably higher ratio of gasoline to conversion than a nonzeolite catalyst.

Additional tests are presented to illustrate the effect when employing a zeolite catalyst in riser cracking at a high velocity without permitting formation of a catalyst bed as compared to cracking systems wherein a catalyst bed is permitted to form with a zeolite catalyst. These tests show that the ratio of gasoline to conversion increses when a riser cracking system (non-dense bed) is employed with a zeolite catalyst as compared to a zeolite fluidized dense bed system.

Further tests were performed to illustrate a riser cracking system employing a zeolite catalyst wherein the total feed gas oil is in a nonhydrogenated condition as compared to a hydrogenated condition. These tests showed that the ratio of gasoline to conversion can be increased in a riser cracking system employing a zeolite catalyst without permitting formation of a catalyst bed anywhere in the reaction flow path by pretreating the total feed via hydrogenation when charging the hydrodesulfurization effluent boiling above the gasoline or furnace oil range to an FCC riser as compared to the same oil in a non-hydrodesulfurized condition.

Finally, tests were performed employing a riser cracking system with a zeolite catalyst without formation of a catalyst bed anywhere in the reaction flow path wherein the feed is hydrogenated to an extent that the temperature differential between the 10 percent distillation point and the 90 percent distillation point increases to varying extents. These tests show that when the prehydrogenation treatment of a virgin gas oil riser feed imparts an increase in temperature differential between the 10 percent distillation point and the 90 percent distillation point which is less than 20° F. a substantial increase in ratio of FCC gasoline to total FCC conversion is achieved when the hydrodesulfurizer effluent boiling above the gasoline range or above the furnace oil range is charged to the FCC riser, as compared to the cracking of the same gas oil in a virgin or nonhydrogenated condition under similar cracking conditions. The tests further show a much smaller increase in FCC gasoline to total FCC conversion ratio when the temperature differential between the 10 and 90 percent distillation points is increased only slightly above 20° F. Finally, further tests show that when this temperature differential is considerably greater than 20° F. there is an actual reduction in ratio of gasoline to total conversion in the cracked product of the hydrogenated feed as compared to the same feed in a nonhydrogenated condition, indicating that excessive feed hydrogenation renders the oil excessively crackable so that gasoline overcracking in the riser results.

These tests are illustrated in the following examples.

EXAMPLE 1

Tests were conducted to illustrate the advantage of a crystalline zeolite aluminosilicate catalyst over an amorphous silica-alumina catalyst in a fluid catalytic cracking system. Both catalysts were tested under sufficiently low space velocity conditions that a dense phase formed in the reactor. The results are shown in Table 14.

TABLE 14

| | Nonzeolite Cracking | Zeolite Cracking |
|---|---|---|
| Charge stock: | | |
| Characterization factor | 12.09 | 11.95 |
| Gravity, ° API | 29.7 | 29.4 |
| Sulfur, percent | 0.42 | 0.36 |
| Viscosity, SUS at ° F. | | |
| 130 | 60.3 | — |
| 150 | 51.1 | — |
| 210 | 38.6 | 37.3 |
| Carbon residue, ramsbottom, percent ASTM D-524 | 0.23 | 0.21 |
| Aniline point, ° F. | 188 | 184 |
| Bromine Number, D-1159 | 2.8 | 3.0 |
| Pour point, D-97, ° F. | 90 | — |
| Nitrogen, ppm | 710 | 450 |
| Metals, ppm: | | |
| Vanadium | 0.2 | 0.4 |
| Nickel | 0.2 | 0.1 |
| Distillation vac. (corres. to 760 mm.Hg): | | |
| 10% over at ° F. | 568 | 556 |
| 30% over at ° F. | 659 | 622 |
| 50% over at ° F. | 744 | 699 |
| 70% over at ° F. | 845 | 809 |
| 90% over at ° F. | 979 | 939 |
| 95% over at ° F. | — | 991 |
| Catalyst | (1) | (2) |
| Kellogg activity (2-hour) | 33.8 | 50.6 |
| Operating conditions, reactor: | | |
| Fresh feed rate, b/d | 13,571 | 13,704 |
| Reactor bed temperature, ° F. | 926 | 935 |
| Feed preheat temperature, ° F. | 700 | 649 |
| Reactor bed pressure, psig | 11.5 | 11.0 |
| Space velocity (total feed), wt/hr/wt | 3.94 | 3.07 |
| Catalyst to oil ratio (total feed), wt/wt | 12.5 | 9.8 |
| Recycle, percent by volume of fresh feed | 74.3 | 31.4 |
| Carbon on regenerated Cat., percent by wt | 0.4 | 0.38 |
| Conversion, percent by volume of fresh feed | 75.5 | 85.5 |
| Operation conditions, regenerator: | | |
| Regen. bed temperature, ° F. | 1,141 | 1,166 |
| Total regen. air, M lb/hr | 153.7 | 166.72 |
| Lb. coke burned/lb. air, wt/wt | 0.087 | 0.083 |
| Yields, percent by volume of fresh feed | | |
| Debutanized gasoline | 47.5 | 61.0 |
| Gasoline/Conversion | 0.63 | 0.71 |
| Butane-Butene | 21.2 | 21.6 |
| i-Butane | 7.6 | 10.3 |
| n-Butane | 2.1 | 1.7 |
| Butenes | 11.6 | 9.6 |
| Propylene: | | |
| Propane | 4.2 | 5.7 |
| Propylene | 8.5 | 5.9 |
| Total liquid recovery | 105.9 | 108.7 |
| $C_2$ and lighter gas, percent by wt | 4.4 | 2.9 |
| Coke, percent by wt | 7.73 | 7.8 |
| Inspections: | | |
| Motor, clear | — | 81.3 |
| Motor, plus 3 cc. TEL | 86.1 | 89.4 |
| Research, clear | 94.0 | 93.4 |
| Research, plus 3 cc. TEL | 100.4 | 98.3 |

(1) 100 percent amorphous silica alumina
(2) 60 percent zeolite, 40 percent silica-alumina As shown in Table 14, the zeolite catalyst stream exhibited a gasoline to conversion ratio of 0.71 as compared to a gasoline to conversion ratio of only 0.63 when employing a nonzeolite catalyst system. The data of Table 14 indicate that the use of a crystalline zeolite catalyst system tends to increase the ratio of gasoline to total conversion as compared to the use of an amorphous catalyst system.

EXAMPLE 2

Further tests were conducted to illustrate the use of the same type of zeolite catalyst employed in Example 1 for fluid catalytic cracking both at relatively high residence times involving space velocities low enough to permit a dense phase catalyst bed to form in the reactor and also at very low residence times at which the velocity through the reactor is sufficiently high that no bed formation within the reactor occurs and therefore no backmixing due to bed formation is permitted to occur. The results are shown in Table 15.

TABLE 15

| Test | 1 | 2 | 3 | 4 |
|---|---|---|---|---|
| Catalyst | (1) | (1) | (1) | (1) |
| Catalyst bed formation | Yes | No | Yes | No |
| Cracking temperature, ° F. | 950 | 950 | 1,000 | 1,000 |
| Space velocity (total feed) | 19.2 | >100 | 19.3 | >100 |
| Contact time, seconds | (2) | 0.5 | (2) | 2.0 |
| Recycle, percent by volume | 2.4 | 5.3 | (3) | (3) |
| Conversion, percent by volume | 72.8 | 77.1 | 76.2 | 80.9 |
| Yields, percent by volume of fresh feed: | | | | |
| Total $C_3$ | 9.9 | 10.4 | 11.7 | 11.3 |
| $C_3=$ | 6.6 | 6.7 | 7.5 | 9.0 |
| Total $C_4$ | 14.2 | 16.0 | 15.8 | 17.7 |
| $C_4=$ | 6.8 | 7.6 | 8.0 | 7.8 |
| Debutanized gasoline | 55.8 | 60.2 | 56.2 | 63.8 |
| Gasoline/Conversion | 0.766 | 0.781 | 0.737 | 0.789 |
| $C_5=$ | 4.8 | 4.8 | 5.0 | 4.3 |
| $C_6$ + + gasoline | 44.2 | 47.9 | 44.8 | 50.8 |
| Total $C_3$ + liquid | 106.8 | 109.5 | 107.5 | 111.9 |
| $C_2$ and lighter, percent by wt | 3.6 | 2.5 | 4.1 | 2.1 |
| Coke, percent by wt | 5.6 | 6.0 | 5.0 | 4.5 |
| Gasoline octane: | | | | |
| Motor, clear | 79.3 | 79.6 | 80.6 | 79.3 |
| Motor, plus 3 cc | 85.4 | 86.2 | 86.4 | 86.3 |
| Research, clear | 92.3 | 92.6 | 93.5 | 91.4 |
| Research, plus 3 cc | 100.2 | 99.6 | 99.5 | 98.7 |
| Δ Sensitivity (clear) | 0 | | −0.8 | |

(1)Zeolite
(2)Bed backmixing
(3)None

A comparison of tests 1 and 2 of Table 15, both conducted at 950° F., shows the depressing effect upon ratio of gasoline to conversion of extended residence time and bed formation when employing a zeolite catalyst. The residence time of Test 2 was only 0.5 seconds so that aftercracking of gasoline is diminished as compared to Test 1 wherein bed formation and resulting oil backmixing tends to permit aftercracking of gasoline. The data show that the gasoline to conversion ratio of Test 2 is higher than the gasoline to conversion ratio of Test 1. The data of Table 15 also show that in tests performed at 1000° F. the gasoline to conversion ratio is also higher when residence time is low and bed formation is not permitted to occur.

EXAMPLE 3

Table 16 shows the inspections of three cracking feedstocks. The first is a virgin Kuwait gas oil, the second is the same gas oil hydrogenated to an extent that the temperature differential between the 10 percent distillation and the 90 percent distillation points is increased 19° F. as compared to said temperature differential of the virgin gas oil, after which 2.1 volume percent of kerosene and lighter was flashed off before being fed to FCC, and the third feedstock is the same gas oil which has been hydrogenated to an extent that the temperature differential between the 10 percent and 90 percent distillation points is increased to 21° F. as compared to said temperature differential of the virgin charge stock, after which 5.0 volume percent of kerosene and lighter was flashed off prior to being fed to FCC.

TABLE 16

VIRGIN AND HYDROGEN PRETREATED KUWAIT GAS OIL - HYDROTREATING CONDITIONS, FCC FEED INSPECTIONS

| Test Feedstock | 1 Virgin Kuwait Gas Oil (not hydrogenated) | 2 Kuwait Gas Oil (hydrogenated) | 3 Kuwait Gas Oil (hydrogenated) |
|---|---|---|---|
| Hydrogenation Operating Conditions | | | |
| Catalyst | | NiCoMo-on-alumina | NiW-on-alumina |
| Space velocity vol/hr/vol | | 2.0 | 2.0 |
| Reactor Pressure: psig | | 1000 | 1900 |
| Reactor Temperature: ° F. | | 720 | 725 |
| Gas Circulation Rate: SCF/B | | 2000 | 6000 |
| Gas Hydrogen Purity: vol % | | 83 | 83 |
| Yields: vol % FF | | | |
| Kerosene and Lighter (removed prior to FCC) | | 2.1 | 5.0 |
| FCC Charge Stock | | 99.2 | 96.6 |
| Hydrogen Consumption: SCF/B | | 460 | 660 |
| FCC Charge Stock Inspections | | | |
| Gravity: ° API | 22.9 | 28.0 | 27.4 |
| Sulfur: wt % | 2.90 | 0.19 | 0.39 |
| Nitrogen: wt % | 0.087 | 0.049 | 0.045 |

TABLE 16-continued

VIRGIN AND HYDROGEN PRETREATED KUWAIT GAS OIL - HYDROTREATING CONDITIONS, FCC FEED INSPECTIONS

| | | | | |
|---|---|---|---|---|
| Aniline Point: F | 175.6 | 188.1 | 192.0 | |
| Calculated Ca (wt fraction of carbon) in aromatic molecules) | 0.234 | 0.178 | 0.164 | |
| Calculated Cn (wt fraction of carbon in naphthenic molecules) | 0.659 | 0.625 | 0.626 | |
| Calculated Cp (wt fraction of carbon in paraffinic molecules) | 0.107 | 0.197 | 0.210 | |
| FCC Feedstock | 1 | 2 | 3 | |
| | | FCC Feed (after 2.1 vol % flashed off from hydrogenator effluent) | FCC Feed (after 5.0 vol % flashed off from hydrogenator effluent | Hydrogenator effluent including the 5 0 vol % flashed |
| Distillation: ° F. End Point | 1070 | 1031 | 1046 | 1007 |
| 5% | 597 | 575 | 603 | 555 |
| 10% | 641 | 622(609° F.)[1] | 634 | 601 |
| 30% | 745 | 726 | 730 | 702 |
| 50% | 813 | 797 | 795 | 778 |
| 70% | 879 | 866 | 861 | 850 |
| 90% | 973 | 964(960° F.)[1] | 951 | 954 |
| Temperature increase in hydrogenator effluent between 10% and 90% due to hydrogenation | | 19° F. | | 21° F. |
| Kerosene and Lighter Inspections | | | | |
| Gravity: ° API | — | 43.3 | 38.8 | |
| Distillation: ° F. | | | | |
| Over Point | — | 206 | 232 | |
| End Point | — | 477 | 501 | |
| 10% | — | 286 | 360 | |
| 50% | — | 379 | 442 | |
| 90% | — | 445 | 475 | |

[1]Calculated value before flash of 2.1 vol % from hydrogenator effluent

EXAMPLE 4

Table 17 illustrates the cracking conditions, yields and FCC product inspections when the feedstocks 1, 2 and 3 of Table 16 are employed in a fluid zeolite riser cracking system without formation of a catalyst bed anywhere in the reaction flow path.

TABLE 17

RISER CRACKING OF VIRGIN AND HYDROGEN PRETREATED KUWAIT GAS OIL - RISER CRACKING OPERATING CONDITIONS AND YIELDS

| Test Feedstock | 1 | 2 | 3 |
|---|---|---|---|
| | Virgin Kuwait Gas Oil | Hydrogenated Kuwait Gas Oil | Hydrogenated Kuwait Gas Oil |
| Operating Conditions | | | |
| Riser Outlet Temp.: ° F. | ← | 1000 | → |
| Contact Time: sec. | ← | 1.3 | → |
| Feed Preheat: F | ← | 600 | → |
| Regen. Cat. Temp.: F | ← | 1180 | → |
| Catalyst | ← | Zeolite | → |
| Slurry Recycle: vol % FF | ← | 0.0 | → |
| Catalyst/Oil Ratio: Wt/Wt | ← | 11.0 | → |
| Carbon on Regen. Cat: Wt % | ← | 0.20 | → |
| Catalyst riser bed formation | ← | No | → |
| Riser Cracking Yields: vol % FF | | | |
| Total $C_3$'s | 11.0 | 11.1 | 11.4 |
| $C_3$ | 1.8 | 1.7 | 1.9 |
| $C_3$= | 9.2 | 9.4 | 9.5 |
| Total $C_4$'s | 18.6 | 18.6 | 21.1 |
| $iC_4$ | 4.6 | 5.7 | 6.3 |
| $nC_4$ | 1.0 | 1.2 | 1.5 |
| $C_4$= | 13.0 | 11.7 | 13.3 |
| $C_5$ - 430F TBP Gasoline | 56.3 | 60.2 | 59.5 |

TABLE 17-continued

RISER CRACKING OF VIRGIN AND HYDROGEN PRETREATED KUWAIT GAS OIL - RISER CRACKING OPERATING CONDITIONS AND YIELDS

Figure 7:
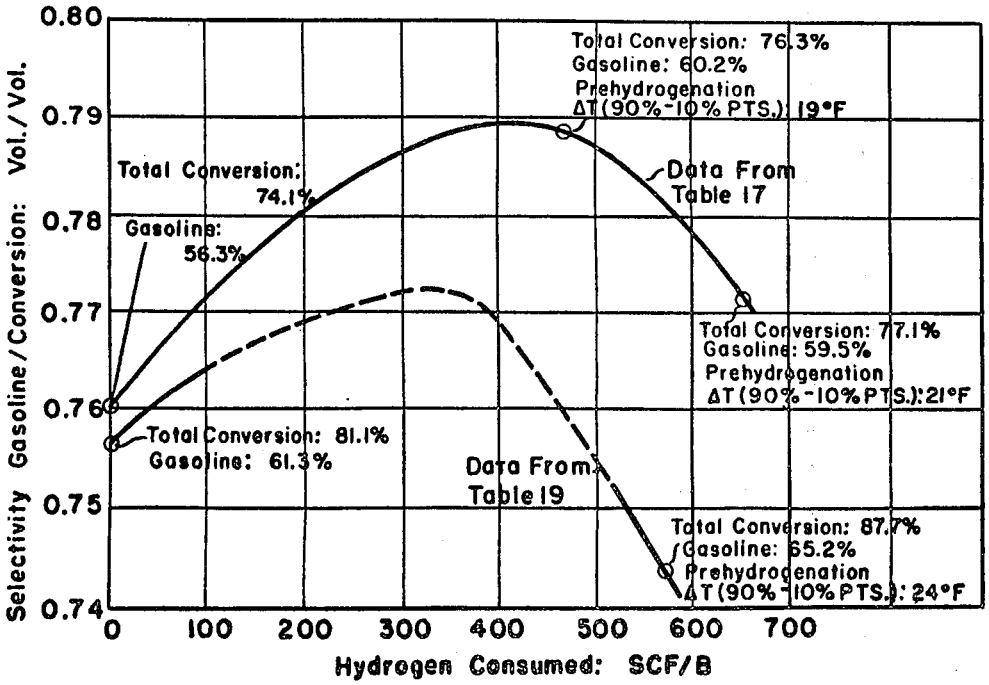

| Test Feedstock | 1 | 2 | 3 |
|---|---|---|---|
| $iC_5$ | 3.8 | 5.9 | 6.0 |
| $nC_5$ | 0.6 | 0.7 | 0.7 |
| $C_5$= | 7.4 | 7.1 | 7.0 |
| $C_6$ + Gasoline | 44.5 | 46.5 | 45.8 |
| Lt. Cat. Gas Oil | 16.2 | 14.4 | 13.8 |
| Decant Oil | 9.7 | 9.3 | 9.1 |
| Riser Cracking Yields: wt % FF | | | |
| $H_2 + C_1 + C_2 = + H_2S$ | 3.3 | 1.7 | 1.9 |
| Coke | 4.6 | 3.7 | 3.8 |
| Total $C_3$ + Liquid: vol % FF | 111.8 | 113.6 | 114.9 |
| Conversion: vol % FF | 74.1 | 76.3 | 77.1 |
| Selectivity: | | | |
| FCC Gasoline/Conversion | 0.760 | 0.789 | 0.772 |
| FCC Gasoline + $C_3$ + $C_4$ Alkylate/Conversion | 1.283 | 1.271 | 1.288 |
| Riser Cracking Product Properties FCC Gasoline ($C_5$ - 430F TBP) | | | |
| Gravity: ° API | 59.0 | 59.4 | 60.2 |
| Sulfur: wt % | 0.28 | 0.018 | 0.022 |
| Hydrocarbon Analysis: vol % | | | |
| Aromatics | 26.5 | 26.4 | 24.9 |
| Olefins | 41.8 | 34.6 | 37.0 |
| Saturates | 31.7 | 39.0 | 38.1 |
| Motor Octane Numbers | | | |
| , Clear | 79.5 | 81.6 | 81.5 |
| , + 0.5 Gm Pb/Gal | 81.5 | 84.2 | 83.9 |
| , + 3.0 Gm Pb/Gal | 83.8 | 88.5 | 87.7 |
| Research Octane Number | | | |
| , Clear | 92.5 | 93.3 | 92.7 |
| , + 0.5 Gm Pb/Gal | 94.4 | 96.2 | 94.8 |
| , + 3.0 Gm Pb/Gal | 97.4 | 100.0 | 99.9 |
| Sensitivity | 13.0 | 11.7 | 11.2 |
| Light Catalytic Gas Oil | | | |
| Gravity: ° API | 17.1 | 22.3 | 22.6 |
| Sulfur: wt % | 4.6 | 0.23 | 0.45 |
| Decant Oil | | | |
| Gravity: ° API | 1.5 | 12.2 | 12.4 |
| Sulfur: wt % | — | 0.88 | 1.44 |

provide about the same FCC gasoline to conversion ratio when each feed was not prehydrogenated, so that each feed has a common base point. FIG. 7 shows that any degree of prehydrogenation (as measured by increase in the difference between the 10 percent and 90 percent distillation points of the feed during prehydrogenation) tends to increase total conversion and gasoline production during riser cracking as compared to the nonhydrogenated feedstock because hydrogenation renders a feed less refractory upon cracking. However, FIG. 7 shows that every degree of prehydrogenation does not subsequently increase both total conversion and gasoline production at the same rate, due to possible overcracking of gasoline while the gasoline remains in the riser due to excessive reduction in the refractory nature of the feed via hydrogenation. The data from Table 17 illustrated in the upper curve of FIG. 7 show that when the extent of prehydrogenation induces an increase in the temperature differential between the 90 percent and 10 percent distillation points by only the small amount from 19° F. to 21° F., a sharp drop in ratio of gasoline to conversion occurs, nearly nullifying the possible improvement in said ratio of gasoline to total conversion due to prehydrogenation. This illustrates the criticality of the 20° F. increase in the temperature differential of the feed during prehydrogenation in accordance with the present invention. The data from Table 19 illustrated in the lower curve of FIG. 7 show that when the temperature difference between the 90 percent and 10 percent points only slightly exceeds 20° F. during prehydrogenation, i.e. when it is 24° F., an actual drop in ratio of gasoline to total conversion occurs due to the prehydrogenation step. However, an important showing made in the lower curve of FIG. 7 is that the very occurrence of a drop in the ratio is not apparent, absent the teaching of the present invention, because the drop in this ratio occurred even though the lower curve of FIG. 7 shows there was a sharp increase in both total FCC conversion and FCC gasoline yield due to prehydrogenation. What FIG. 7 shows is that overcracking of FCC gasoline in the riser which results in a loss in ratio of gasoline to total conversion can nullify the advantage of prehydrogenation otherwise attainable in this respect. The upper curve of FIG. 7 further shows that the loss in ratio of gasoline to total conversion can be accompanied by a net loss of gasoline yield as compared to the peak gasoline yield when the desired ratio is near a maximum, even though the lowered gasoline yield is still higher than the gasoline yield of the non-prehydrogenated feed. However, the important showing of FIG. 7 is that in all cases any degree of prehydrogenation results in an increase of both total conversion and gasoline yield as compared to a non-prehydrogenated feed, thereby obscuring the presence or absence of the ratio improvement which can be a possible concomitant with the increase in yields by following the teaching of the present invention.

An important showing of Table 19 is that a high degree of prehydrogenation does not increase the ratio of FCC gasoline $+C_3+C_4$ alkylate to total conversion. In fact, this latter ratio in Table 19 for a hydrogenated feed is even lower than that for a non-hydrogenated feed and is furthermore even lower than that shown for the feed illustrated in Table 17 which was subjected to more mild prehydrogenation, showing that severe hydrogenation is economically wasteful in that it does not produce a ratio peak for FCC + alkylate gasoline to conversion, such as is possible for the FCC gasoline alone, whereas severe prehydrogenation uneconomically consumes additional hydrogen, requires a greater thickness in the wall of the prehydrogenator reactor due to higher hydrogen pressure requirements and puts a greater load on the alkylation reactor due to increased yields of $C_3$'s + $C_4$'s from the FCC riser.

EXAMPLE 7

Additional tests were performed which show an additional advantage beyond that heretofore described when a minor proportion of coker distillate gas oil is blended with a major proportion of virgin distillate gas oil to prepare an FCC feedstock. These tests show that when 1 to 20 volume percent, generally, or 5 to 15 volume percent, preferably, of coker gas oil is blended with a virgin gas oil prior to hydrodesulfurization to prepare an FCC feedstock there is an unexpected additional improvement in all of the following: in total conversion, in gasoline yield, in the ratio of FCC gasoline to total conversion, and in the ratio of FCC gasoline plus alkylate gasoline to total conversion, as compared to separate hydrodesulfurization and riser cracking treatment of the virgin gas oil and the coker gas oil. The blend also results in a large decrease in sensitivity of the FCC gasoline. These advantages are illustrated in the following data.

Table 20 shows the inspections of nonhydrogenated West Texas riser cracking feedstocks. Table 20 shows the inspection of a West Texas nonhydrogenated virgin gas oil, a nonhydrogenated West Texas coker gas oil and a blend of these two gas oils containing 8 volume percent of coker gas oil with 92 volume percent of virgin gas oil.

TABLE 20

INSPECTIONS OF NON-HYDROGENATED RISER CRACKING WEST TEXAS FCC FEEDS

| Test Feedstock | 1 | 2 | 3 |
|---|---|---|---|
| | Non-hydrogenated West Texas Virgin Gas Oil | Non-hydrogenated West Texas Coker Gas Oil | Non-hydrogenated West Texas 92 vol % virgin + 8 vol % coker gas oil blend |
| Inspections | | | |
| Gravity: ° API | 24.0 | 21.4 | 23.5 |
| Sulfur: wt % | 1.75 | 2.04 | 1.78 |
| Nitrogen: wt % | 0.093 | 0.25 | 0.105 |
| Aniline Point: F | 179.9 | 148.1 | 176.8 |
| Calculated Ca | 0.211 | 0.255 | 0.216 |
| Calculated Cn | 0.164 | 0.215 | 0.178 |
| Calculated Cp | 0.625 | 0.529 | 0.606 |
| Distillation, ° F. | | | |
| End Point | 1033 | 855 | 1024 |

TABLE 20-continued

INSPECTIONS OF NON-HYDROGENATED RISER CRACKING WEST TEXAS FCC FEEDS

| Test Feedstock | 1 | 2 | 3 |
|---|---|---|---|
| | Non-hydrogenated West Texas Virgin Gas Oil | Non-hydrogenated West Texas Coker Gas Oil | Non-hydrogenated West Texas 92 vol % virgin + 8 vol % coker gas oil blend |
| 5% | 615 | 610 | 612 |
| 10% | 666 | 653 | 656 |
| 30% | 735 | 702 | 733 |
| 50% | 800 | 728 | 794 |
| 70% | 870 | 754 | 862 |
| 90% | 966 | 793 | 964 |
| Volume Average Boiling Point.: ° F. | 808 | 726 | 802 |

Table 21 shows results of riser cracking of the West Texas non-hydrogenated gas oils described in Table 20.

TABLE 21

RISER CRACKING OF NON-HYDROGENATED WEST TEXAS CRUDE DERIVED GAS OILS

| Feedstock | 1 | 2 | 3 | 4 |
|---|---|---|---|---|
| | Non-hydrogenated West Texas Virgin Gas Oil | Non-hydrogenated West Texas Coker Gas Oil | Non-hydrogenated West Texas 92 vol % Virgin + 8 vol % Coker Gas Oil Blend | Calculated Results from Riser Cracking 92 vol % of Test Feedstock 1 + 8 vol % of Test Feedstock 2 Non-hydrogenated |
| Operating Conditions | | | | |
| Riser Average Temperature: ° F. | ← | 1020 | → | — |
| Contact Time: sec. | ← | 2.77 | → | — |
| Feed Preheat: ° F. | 500 | 600 | 500 | — |
| Regen. Cat. Temp.: ° F. | 1180 | 1260 | 1180 | — |
| Catalyst | ← | zeolite | → | |
| Slurry Recycle: vol % FF | 7.0 | 0.0 | 7.0 | — |
| Cat/Oil Ratio: wt/wt | 8.5 | 10.0 | 8.5 | — |
| Carbon on Regen. Cat: wt % | ← | 0.2 | → | — |
| Catalyst Bed Formation | ← | No | → | — |
| Riser Cracking Yields: vol % FF | | | | |
| Total $C_3$'s | 10.5 | 9.4 | 9.9 | 10.4 |
| $C_3$ | 1.7 | 1.7 | 1.7 | 1.7 |
| $C_3=$ | 8.8 | 7.7 | 8.2 | 8.7 |
| Total $C_4$'s | 18.7 | 14.8 | 17.3 | 18.5 |
| $iC_4$ | 5.3 | 4.1 | 4.9 | 5.2 |
| $nC_4$ | 1.2 | 1.0 | 1.0 | 1.2 |
| $C_4=$ | 12.3 | 9.7 | 11.4 | 12.1 |
| $C_5$ - 430 F TBP Gasoline | 61.2 | 46.9 | 60.8 | 60.1 |
| $iC_5$ | 5.2 | 4.2 | 4.6 | 5.1 |
| $nC_5$ | 0.6 | 0.5 | 0.4 | 0.6 |
| $C_5=$ | 6.0 | 4.6 | 4.3 | 5.9 |
| $C_6$ + Gasoline | 49.4 | 37.6 | 51.5 | 48.5 |
| Lt. Cat. Gas Oil | 13.6 | 16.7 | 15.8 | 13.9 |
| Decant Oil | 7.2 | 19.0 | 7.3 | 8.2 |
| Riser Cracking Yields: wt % FF | | | | |
| $H_2 + C_1 + C_2 + C_2= + H_2S$ | 3.4 | 2.7 | 3.3 | 3.3 |
| Coke | 4.9 | 6.0 | 4.7 | 5.0 |
| Total $C_3$ + Liquid: vol % FF | 111.2 | 106.8 | 111.1 | 111.1 |
| Conversion: vol % FF | 79.2 | 64.3 | 76.9 | 77.9 |
| Selectivity | | | | |
| FCC Gasoline/Conversion | 0.773 | 0.729 | 0.791 | 0.769 |
| FCC + $C_3$ + $C_4$ Alky. Gaso./Conv. | 1.238 | 1.202 | 1.236 | 1.232 |
| FCC Gasoline Properties | | | | |
| Gravity: ° API | 57.3 | 57.5 | 58.0 | — |
| Sulfur: wt % | 0.16 | 0.28 | 0.14 | — |
| Motor Octane No., Clear | 79.1 | 79.7 | 78.8 | — |
| Research Octane No., Clear | 91.3 | 92.3 | 91.7 | — |
| Sensitivity | 12.2 | 12.6 | 12.9 | — |

Table 21 also shows the calculated results of riser cracking of a blend containing 8 volume percent of coker gas oil with 92 volume percent of virgin gas oil.

Table 22 shows hydrogenation conditions and inspections of hydrogenated feedstocks previously illustrated in Tables 20 and 21.

provide about the same FCC gasoline to conversion ratio when each feed was not prehydrogenated, so that each feed has a common base point. FIG. 7 shows that any degree of prehydrogenation (as measured by increase in the difference between the 10 percent and 90 percent distillation points of the feed during prehydrogenation) tends to increase total conversion and gasoline production during riser cracking as compared to the nonhydrogenated feedstock because hydrogenation renders a feed less refractory upon cracking. However, FIG. 7 shows that every degree of prehydrogenation does not subsequently increase both total conversion and gasoline production at the same rate, due to possible overcracking of gasoline while the gasoline remains in the riser due to excessive reduction in the refractory nature of the feed via hydrogenation. The data from Table 17 illustrated in the upper curve of FIG. 7 show that when the extent of prehydrogenation induces an increase in the temperature differential between the 90 percent and 10 percent distillation points by only the small amount from 19° F. to 21° F., a sharp drop in ratio of gasoline to conversion occurs, nearly nullifying the possible improvement in said ratio of gasoline to total conversion due to prehydrogenation. This illustrates the criticality of the 20° F. increase in the temperature differential of the feed during prehydrogenation in accordance with the present invention. The data from Table 19 illustrated in the lower curve of FIG. 7 show that when the temperature difference between the 90 percent and 10 percent points only slightly exceeds 20° F. during prehydrogenation, i.e. when it is 24° F., an actual drop in ratio of gasoline to total conversion occurs due to the prehydrogenation step. However, an important showing made in the lower curve of FIG. 7 is that the very occurrence of a drop in the ratio is not apparent, absent the teaching of the present invention, because the drop in this ratio occurred even though the lower curve of FIG. 7 shows there was a sharp increase in both total FCC conversion and FCC gasoline yield due to prehydrogenation. What FIG. 7 shows is that overcracking of FCC gasoline in the riser which results in a loss in ratio of gasoline to total conversion can nullify the advantage of prehydrogenation otherwise attainable in this respect. The upper curve of FIG. 7 further shows that the loss in ratio of gasoline to total conversion can be accompanied by a net loss of gasoline yield as compared to the peak gasoline yield when the desired ratio is near a maximum, even though the lowered gasoline yield is still higher than the gasoline yield of the non-prehydrogenated feed. However, the important showing of FIG. 7 is that in all cases any degree of prehydrogenation results in an increase of both total conversion and gasoline yield as compared to a non-prehydrogenated feed, thereby obscuring the presence or absence of the ratio improvement which can be a possible concomitant with the increase in yields by following the teaching of the present invention.

An important showing of Table 19 is that a high degree of prehydrogenation does not increase the ratio of FCC gasoline $+C_3+C_4$ alkylate to total conversion. In fact, this latter ratio in Table 19 for a hydrogenated feed is even lower than that for a non-hydrogenated feed and is furthermore even lower than that shown for the feed illustrated in Table 17 which was subjected to more mild prehydrogenation, showing that severe hydrogenation is economically wasteful in that it does not produce a ratio peak for FCC + alkylate gasoline to conversion, such as is possible for the FCC gasoline alone, whereas severe prehydrogenation uneconomically consumes additional hydrogen, requires a greater thickness in the wall of the prehydrogenator reactor due to higher hydrogen pressure requirements and puts a greater load on the alkylation reactor due to increased yields of $C_3$'s + $C_4$'s from the FCC riser.

EXAMPLE 7

Additional tests were performed which show an additional advantage beyond that heretofore described when a minor proportion of coker distillate gas oil is blended with a major proportion of virgin distillate gas oil to prepare an FCC feedstock. These tests show that when 1 to 20 volume percent, generally, or 5 to 15 volume percent, preferably, of coker gas oil is blended with a virgin gas oil prior to hydrodesulfurization to prepare an FCC feedstock there is an unexpected additional improvement in all of the following: in total conversion, in gasoline yield, in the ratio of FCC gasoline to total conversion, and in the ratio of FCC gasoline plus alkylate gasoline to total conversion, as compared to separate hydrodesulfurization and riser cracking treatment of the virgin gas oil and the coker gas oil. The blend also results in a large decrease in sensitivity of the FCC gasoline. These advantages are illustrated in the following data.

Table 20 shows the inspections of nonhydrogenated West Texas riser cracking feedstocks. Table 20 shows the inspection of a West Texas nonhydrogenated virgin gas oil, a nonhydrogenated West Texas coker gas oil and a blend of these two gas oils containing 8 volume percent of coker gas oil with 92 volume percent of virgin gas oil.

TABLE 20

INSPECTIONS OF NON-HYDROGENATED RISER CRACKING WEST TEXAS FCC FEEDS

| Test Feedstock | 1 | 2 | 3 |
|---|---|---|---|
| | Non-hydrogenated West Texas Virgin Gas Oil | Non-hydrogenated West Texas Coker Gas Oil | Non-hydrogenated West Texas 92 vol % virgin + 8 vol % coker gas oil blend |
| Inspections | | | |
| Gravity: ° API | 24.0 | 21.4 | 23.5 |
| Sulfur: wt % | 1.75 | 2.04 | 1.78 |
| Nitrogen: wt % | 0.093 | 0.25 | 0.105 |
| Aniline Point: F | 179.9 | 148.1 | 176.8 |
| Calculated Ca | 0.211 | 0.255 | 0.216 |
| Calculated Cn | 0.164 | 0.215 | 0.178 |
| Calculated Cp | 0.625 | 0.529 | 0.606 |
| Distillation, ° F. | | | |
| End Point | 1033 | 855 | 1024 |

TABLE 20-continued

INSPECTIONS OF NON-HYDROGENATED RISER CRACKING WEST TEXAS FCC FEEDS

| Test Feedstock | 1 | 2 | 3 |
|---|---|---|---|
| | Non-hydrogenated West Texas Virgin Gas Oil | Non-hydrogenated West Texas Coker Gas Oil | Non-hydrogenated West Texas 92 vol % virgin + 8 vol % coker gas oil blend |
| 5% | 615 | 610 | 612 |
| 10% | 666 | 653 | 656 |
| 30% | 735 | 702 | 733 |
| 50% | 800 | 728 | 794 |
| 70% | 870 | 754 | 862 |
| 90% | 966 | 793 | 964 |
| Volume Average Boiling Point.: ° F. | 808 | 726 | 802 |

Table 21 shows results of riser cracking of the West Texas non-hydrogenated gas oils described in Table 20.

TABLE 21

RISER CRACKING OF NON-HYDROGENATED WEST TEXAS CRUDE DERIVED GAS OILS

| Feedstock | 1 | 2 | 3 | 4 |
|---|---|---|---|---|
| | Non-hydrogenated West Texas Virgin Gas Oil | Non-hydrogenated West Texas Coker Gas Oil | Non-hydrogenated West Texas 92 vol % Virgin + 8 vol % Coker Gas Oil Blend | Calculated Results from Riser Cracking 92 vol % of Test Feedstock 1 + 8 vol % of Test Feedstock 2 Non-hydrogenated |
| Operating Conditions | | | | |
| Riser Average Temperature: ° F. | ← | 1020 | → | — |
| Contact Time: sec. | ← | 2.77 | → | — |
| Feed Preheat: ° F. | 500 | 600 | 500 | — |
| Regen. Cat. Temp.: ° F. | 1180 | 1260 | 1180 | — |
| Catalyst | ← | zeolite | → | |
| Slurry Recycle: vol % FF | 7.0 | 0.0 | 7.0 | — |
| Cat/Oil Ratio: wt/wt | 8.5 | 10.0 | 8.5 | — |
| Carbon on Regen. Cat: wt % | ← | 0.2 | → | — |
| Catalyst Bed Formation | ← | No | → | — |
| Riser Cracking Yields: vol % FF | | | | |
| Total $C_3$'s | 10.5 | 9.4 | 9.9 | 10.4 |
| $C_3$ | 1.7 | 1.7 | 1.7 | 1.7 |
| $C_3 =$ | 8.8 | 7.7 | 8.2 | 8.7 |
| Total $C_4$'s | 18.7 | 14.8 | 17.3 | 18.5 |
| $iC_4$ | 5.3 | 4.1 | 4.9 | 5.2 |
| $nC_4$ | 1.2 | 1.0 | 1.0 | 1.2 |
| $C_4 =$ | 12.3 | 9.7 | 11.4 | 12.1 |
| $C_5$ - 430 F TBP Gasoline | 61.2 | 46.9 | 60.8 | 60.1 |
| $iC_5$ | 5.2 | 4.2 | 4.6 | 5.1 |
| $nC_5$ | 0.6 | 0.5 | 0.4 | 0.6 |
| $C_5 =$ | 6.0 | 4.6 | 4.3 | 5.9 |
| $C_6$ + Gasoline | 49.4 | 37.6 | 51.5 | 48.5 |
| Lt. Cat. Gas Oil | 13.6 | 16.7 | 15.8 | 13.9 |
| Decant Oil | 7.2 | 19.0 | 7.3 | 8.2 |
| Riser Cracking Yields: wt % FF | | | | |
| $H_2 + C_1 + C_2 + C_2 = + H_2S$ | 3.4 | 2.7 | 3.3 | 3.3 |
| Coke | 4.9 | 6.0 | 4.7 | 5.0 |
| Total $C_3$ + Liquid: vol % FF | 111.2 | 106.8 | 111.1 | 111.1 |
| Conversion: vol % FF | 79.2 | 64.3 | 76.9 | 77.9 |
| Selectivity | | | | |
| FCC Gasoline/Conversion | 0.773 | 0.729 | 0.791 | 0.769 |
| FCC + $C_3$ + $C_4$ Alky. Gaso./Conv. | 1.238 | 1.202 | 1.236 | 1.232 |
| FCC Gasoline Properties | | | | |
| Gravity: ° API | 57.3 | 57.5 | 58.0 | — |
| Sulfur: wt % | 0.16 | 0.28 | 0.14 | — |
| Motor Octane No., Clear | 79.1 | 79.7 | 78.8 | — |
| Research Octane No., Clear | 91.3 | 92.3 | 91.7 | — |
| Sensitivity | 12.2 | 12.6 | 12.9 | — |

Table 21 also shows the calculated results of riser cracking of a blend containing 8 volume percent of coker gas oil with 92 volume percent of virgin gas oil.

Table 22 shows hydrogenation conditions and inspections of hydrogenated feedstocks previously illustrated in Tables 20 and 21.

TABLE 22

HYDROGENATION CONDITIONS AND INSPECTIONS OF HYDROGENATED RISER CRACKING FEEDS OF WEST TEXAS CRUDE ORIGIN

| Feedstock | 1 | 2 | 3 | 4 |
|---|---|---|---|---|
| | Hydrogenated West Texas Virgin Gas Oil | Hydrogenated West Texas Coker Gas Oil | Hydrogenated West Texas 92 vol % Virgin + 8 vol % Coker Gas Oil Blend | Calculated Results from Combining 92 vol % of Test Feedstock 1 + 8 vol % of Test Feedstock 2 Hydrogenated |
| Hydrogenation Conditions | | | | |
| Catalyst | NiCoMo-on-alumina | NiW-on-alumina | NiCoMo-on-alumina | — |
| Space Velocity: vol/hr/vol | 2.0 | 1.0 | 2.0 | 1.92 |
| Reactor Pressure: psig | 1000 | 1500 | 1000 | 1040 |
| Gas Circulation Rate: SCF/Bbl | 2000 | 10,000 | 2000 | 2640 |
| Gas Hydrogen Purity: vol % | ← | 80 | → | 80 |
| Reactor Temperature: ° F. | 690 | 650 | 705 | 687 |
| Yields: vol % FF | | | | |
| $C_5$ + Liquid Product | 100.4 | 101.5 | 100.4 | 100.5 |
| Hydrogen Consumption: SCF/Bbl | 300 | 600 | 325 | 324 |
| FCC Charge Stock Inspections | | | | |
| Gravity: ° API | 28.1 | 25.5 | 27.7 | 27.9 |
| Sulfur: wt % | 0.17 | 0.41 | 0.21 | 0.20 |
| Nitrogen: wt % | 0.069 | 0.17 | — | — |
| Aniline Point: ° F. | 190.8 | 154.6 | 192.0 | 187.9 |
| Calculated Ca | 0.156 | 0.198 | 0.149 | 0.159 |
| Calculated Cn | 0.238 | 0.313 | 0.243 | 0.244 |
| Calculated Cp | 0.606 | 0.489 | 0.608 | 0.597 |
| Distillation: ° F. | | | | |
| End Point | 1041 | 841 | 1028 | — |
| 5% | 560 | 550 | 562 | — |
| 10% | 627 | 601 | 632 | — |
| 30% | 714 | 673 | 707 | — |
| 50% | 779 | 702 | 774 | — |
| 70% | 852 | 735 | 845 | — |
| 90% | 944 | 779 | 949 | — |
| Temperature Increase Between 10% and 90% Points due to hydrogenation: ° F. | 17 | 38 | 19 | — |

It is noted that the 8 volume percent coker gas oil and 92 volume percent virgin gas oil when hydrogenated as a blend is unexpectedly improved in regard to aniline point and in regard to the weight fraction of carbon in aromatic molecules.

Table 23 illustrates the results of riser cracking of the hydrogenated gas oils of Table 22.

TABLE 23

RISER CRACKING OF HYDROGENATED WEST TEXAS CRUDE DERIVED GAS OILS
Contact Time: sec.

| Feedstock | 1 | 2 | 3 | 4 |
|---|---|---|---|---|
| | Hydrogenated West Texas Virgin Gas Oil | Hydrogenated West Texas Coker Gas Oil | Hydrogenated West Texas 92 vol % Virgin + 8 vol % Coker Gas Oil Blend | Calculated Results from Riser Cracking 92 vol % of Test Feedstock 1 + 8 vol % of Test Feedstock 2 Hydrogenated |
| Operating Conditions | | | | |
| Riser Average Temperature: ° F. | ← | 1020 | → | — |
| Contact Time: sec. | ← | 2.6 | → | — |
| Feed Preheat: ° F. | 500 | 600 | 500 | — |
| Regen. Cat. Temp.: ° F. | 1180 | 1260 | 1180 | — |
| Catalyst | ← | zeolite | → | — |
| Slurry Recycle: vol % FF | 7.0 | 0.0 | 7.0 | — |
| Cat/Oil Ratio: wt/wt | 9.0 | 10.5 | 9.0 | — |
| Carbon on Regen. Cat.: wt % | ← | 0.02 | → | — |
| Catalyst Bed Formation | ← | No | → | — |
| Riser Cracking Yields: vol % FF | | | | |
| Total $C_3$'s | 10.1 | 12.3 | 10.5 | 10.2 |
| $C_3$ | 1.5 | 2.1 | 1.4 | 1.5 |
| $C_3$ = | 8.6 | 10.2 | 9.1 | 8.7 |
| Total $C_4$'s | 19.1 | 20.1 | 19.7 | 19.2 |
| $iC_4$ | 6.2 | 6.7 | 5.9 | 6.3 |
| $nC_4$ | 1.1 | 1.5 | 1.1 | 1.1 |
| $C_4$ = | 11.8 | 11.9 | 12.7 | 11.8 |
| $C_5$ - 430 F TBP Gasoline | 64.7 | 52.7 | 65.4 | 63.8 |

TABLE 23-continued

RISER CRACKING OF HYDROGENATED WEST TEXAS
Contact Time: sec.
CRUDE DERIVED GAS OILS

| Feedstock | 1 | 2 | 3 | 4 |
|---|---|---|---|---|
| $iC_5$ | 6.6 | 4.8 | 6.9 | 6.5 |
| $nC_5$ | 0.9 | 0.6 | 1.0 | 0.9 |
| $C_5=$ | 8.6 | 5.0 | 8.9 | 8.3 |
| $C_6$ + Gasoline | 48.6 | 42.3 | 48.6 | 48.1 |
| Lt. Cat. Gas Oil | 14.8 | 15.7 | 14.7 | 14.9 |
| Decant Oil | 4.1 | 10.6 | 3.5 | 4.6 |
| Riser Cracking Yields: wt % FF | | | | |
| $H_2 + C_1 + C_2 + C_2= + H_2S$ | 2.2 | 2.1 | 2.1 | 2.2 |
| Coke | 3.8 | 4.9 | 3.6 | 3.9 |
| Total $C_3$ + Liquid: vol % FF | 112.8 | 111.4 | 113.8 | 112.7 |
| Conversion: vol % FF | 81.1 | 73.7 | 81.8 | 80.5 |
| Selectivity | | | | |
| FCC Gasoline/Conversion | 0.798 | 0.715 | 0.800 | 0.793 |
| FCC + $C_3$ + $C_4$ Alky. Gaso./Conv. | 1.236 | 1.239 | 1.264 | 1.237 |
| FCC Gasoline Properties | | | | |
| Gravity: ° API | 58.0 | 56.5 | 59.5 | — |
| Sulfur: wt % | 0.026 | 0.040 | 0.030 | — |
| Motor Octane No., Clear | 79.4 | 80.9 | 79.6 | — |
| Research Octane No., Clear | 91.2 | 93.5 | 90.5 | — |
| Sensitivity | 11.8 | 12.4 | 10.9 | — |

Table 23 shows that the calculated results based on independent cracking of the hydrogenated virgin gas oil and the hydrogenated coker gas oil indicate a gasoline yield of 63.8 percent for the blend, whereas 65.4 percent gasoline for the hydrogenated blend was actually achieved; the calculated results based on independent cracking show that the conversion (volume percent of fresh feed) with the blend should have been 80.5, whereas the actual conversion with the blend was 81.8; the calculated results based upon independent cracking indicate that the FCC gasoline to conversion ratio with the blend should have been 0.793 whereas the actual ratio was 0.800; the calculated results based upon independent cracking indicate that the FCC + alkylate gasoline to conversion ratio with the blend should have been 1.237 whereas an actual ratio with the blend of 1.264 was actually achieved. Therefore, in all of these respects the blending of a minor proportion of coker gas oil with the virgin gas oil prior to hydrogenation produced unexpectedly advantageous results.

It is also noted that the gasoline product of the hydrogenated blend had a sensitivity of only 10.9 whereas the gasoline product of the non-hydrogenated blend was much higher, being 12.9.

The tables of this example further confirm the importance of the increase in temperature differential between the 10 and 90 percent points of the FCC feedstocks upon hydrogenation. For example, when the virgin gas oil was hydrogenated the temperature increase between the 10 and 90 percent distillation points due to hydrogenation was 17° F. and because this temperature increase is lower than 20° F. the selectivity of FCC gasoline to conversion on subsequent riser cracking was increased from a non-hydrogenation ratio of 0.773 to 0.798. On the other hand, the temperature increase between the 10 and 90 percent distillation points in the coker gas oil upon hydrogenation was 38° F., which is well above the 20° F. limit of the present invention. As a result, the data show that the ratio of FCC gasoline to total conversion upon subsequent riser cracking as a result of hydrogenation diminished from a non-hydrogenation ratio of 0.729 to 0.715, further confirming the criticality of the 20° F. increase limit in temperature differential upon hydrogenation of an FCC feedstock.

We claim:

1. A hydrodesulfurization process comprising blending separate non-asphaltic sulfur-containing petroleum hydrocarbon oil fractions each having a volume average boiling point of at least 700° F. to form a blended oil stream, both of said fractions boiling above 1,000° F. but one of said fractions having a boiling range higher than the other, passing said blended stream together with hydrogen downflow over a fixed bed of hydrodesulfurization catalyst comprising Group VI and Group VIII metals on a non-cracking alumina support to remove at least 80 weight percent of the sulfur from said blended stream, and regulating the amount of hydrodesulfurization catalyst in the bed to avoid excessively decreasing the boiling characteristics of the blended oil stream whereby an increase in the temperature differential between the 10 and 90 percent boiling points of the blended stream occurs but does not exceed 20° F., while the 90 percent boiling point of the blended stream is decreased at least 10° F.

2. The process of claim 1 wherein one of the blended fractions is virgin gas oil.

3. The process of claim 1 wherein one of the blended fractions is coker gas oil.

4. The process of claim 1 wherein one of the blended fractions is lubricating oil.

5. The process of claim 1 including the step of separating the hydrodesulfurized oil fractions.

* * * * *

UNITED STATES PATENT AND TRADEMARK OFFICE

CERTIFICATE OF CORRECTION

PATENT NO. : 3,997,430
DATED : December 14, 1976
INVENTOR(S) : Robert D. Christman, Joel D. McKinney, Thomas C. Readal and Stephen J. Yanik It is certified that error appears in the above-identified patent and that said Letters Patent are hereby corrected as shown below:

COL. 19, line 41, "about" should read --above--

COL. 32, Table 16, "50 vol" should read --5.0 vol--

COL. 35, Table 19, "Cat/oil Ratio: Wt/Wt" (first occurrence) should read --Slurry Recycle: Vol % FF--

COL. 35, Table 19, "Riser Catalyst Bed Formation" (first occurrence) should read -- Carbon on Regen. Cat.: wt %--

COL. 41-42, Table 22, In column 3, "632" should read --622--

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*